United States Patent [19]

Kanamaru et al.

[11] Patent Number: 4,897,317

[45] Date of Patent: Jan. 30, 1990

[54] CORROSION RESISTANT ZN-CR PLATED STEEL STRIP

[75] Inventors: Tatsuya Kanamaru; Motohiro Nakayama; Katutoshi Arai; Shinichi Suzuki; Ryoichi Naka, all of Tokai, Japan

[73] Assignee: Nippon Steel Corporation, Tokyo, Japan

[21] Appl. No.: 174,830

[22] Filed: Mar. 29, 1988

[30] Foreign Application Priority Data

| | | | |
|---|---|---|---|
| Mar. 31, 1987 | [JP] | Japan | 62-79027 |
| Aug. 6, 1987 | [JP] | Japan | 62-195343 |
| Aug. 6, 1987 | [JP] | Japan | 62-195344 |
| Aug. 26, 1987 | [JP] | Japan | 62-210253 |
| Aug. 26, 1987 | [JP] | Japan | 62-210254 |
| Sep. 22, 1987 | [JP] | Japan | 62-237765 |
| Sep. 22, 1987 | [JP] | Japan | 62-237766 |
| Dec. 17, 1987 | [JP] | Japan | 62-319830 |
| Dec. 17, 1987 | [JP] | Japan | 62-319831 |
| Jan. 8, 1988 | [JP] | Japan | 63-1187 |
| Jan. 26, 1988 | [JP] | Japan | 63-15156 |
| Jan. 28, 1988 | [JP] | Japan | 63-17626 |
| Feb. 23, 1988 | [JP] | Japan | 63-40292 |
| Feb. 23, 1988 | [JP] | Japan | 63-40293 |

[51] Int. Cl.[4] ..... B32B 15/18

[52] U.S. Cl. ..... 428/629; 428/659

[58] Field of Search ..... 428/622, 626, 629, 659, 428/682

[56] References Cited

U.S. PATENT DOCUMENTS

| | | | |
|---|---|---|---|
| 4,650,724 | 3/1987 | Umino et al. | 428/659 |

FOREIGN PATENT DOCUMENTS

| | | | |
|---|---|---|---|
| 174019 | 3/1986 | European Pat. Off. | 428/659 |
| 0182964 | 6/1986 | European Pat. Off. . | |
| 50195 | 3/1985 | Japan . | |
| 2053970 | 2/1981 | United Kingdom . | |

*Primary Examiner*—Robert McDowell

*Attorney, Agent, or Firm*—Kenyon & Kenyon

[57] ABSTRACT

A plated steel strip having an enhanced corrosion and rust resistance and an improved paint-coating property comprises a principal plating layer formed on a steel strip substrate and comprising a co-deposited zinc-chromium based alloy which comprises more than 5% by weight but not more than 40% by weight of chromium and the balance of zinc.

8 Claims, 8 Drawing Sheets

CORROSION RESISTANT ZN-CR PLATED STEEL STRIP

BACKGROUND OF THE INVENTION

1. Field of the Invention

The present invention relates to a corrosion resistant plated steel strip. More particularly, the present invention relates to a high corrosion and rust resistant plated steel strip having a zinc-based alloy base plating layer and thus useful for transportation vehicles, for example, cars and trucks, building materials, and electric appliance.

2. Description of Related Arts

It is known that a steel strip plated with zinc and a zinc-based alloy exhibits an enhanced resistance to corrosion and rust. This corrosion resistance of the plating layer consisting of zinc or a zinc-based alloy is mainly derived from a self-sacrificing anti-corrosional action of zinc.

However, it is also known that, if a steel strip plated with zinc or a zinc-based alloy is used in a corrosional circumstance, particularly in the presence of salt, zinc is dissolved at a relatively high rate, and thus the corrosion resistance of the plated steel strip cannot be maintained at a high level.

The reasons for the above-mentioned phenomenon are as follows.

First, zinc has a higher ionization tendency and lower electric potential than those of iron. Therefore, an excessively large Zn-Fe coupling current flows, in a zinc-plated steel strip and thus zinc is dissolved at a high rate.

Second, the corrosion product of zinc has a high conductivity of the corrosion electric current, and thus the membrane of corrosion product is easily dissolved.

To avoid the above-mentioned disadvantages, attempts have been made to plate a steel strip substrate surface with a zinc-based alloy containing iron and/or nickel. The resultant plating alloy layer has a high electric potential than pure zinc and a smaller potential difference between iron and the zinc alloy than that between iron and pure zinc. This feature restricts the flow of corrosion current through the plated steel strip, and thus the plating layer can protect the steel strip substrate over a longer period.

Japanese Examined Patent Publication (Kokoku) No. 58-15,554 discloses a plated steel strip having a plating layer comprising a zinc-iron alloy or a zinc-nickel alloy. This plating layer is disadvantageous in that an iron component in the zinc-iron alloy-plating layer is corroded so as to form red rust. In the zinc-nickel alloy-plating layer, the corrosion rate of nickel is very low. This feature results in a remaining of nickel in the state of metal in the corroded plating layer, and the metallic nickel on the steel strip substrate undesirably promotes perforation corrosion of the steel strip substrate.

Japanese Unexamined Patent Publication (Kokai) Nos. 61-127,900, 61-270,398, 61-235,600 and 61-266,598 discloses a corrosion-resistant plated steel strip having a zinc-based plating layer containing alumina or silica colloidal particles dispersed therein.

However, the corrosion-preventing effect of the alumina and silica colloidal particles is unsatisfactory. Also, the alumina or silica colloidal particle-containing plating layer exhibits a poor appearance.

Japanese Examined Patent Publication No. 49-3610 and Japanese Unexamined Patent Publication No. 61-270,398 discloses a plated steel strip having a zinc-iron alloy-plating layer. This plated steel strip exhibits an enhanced corrosion resistance after being coated with an organic paint, and thus is useful for industrial purposes However, a further enhancement of the corrosion resistance is strongly desired.

Japanese Examined Patent Publication (Kokoku) Nos. 61-36078 and 58-56039 and Japanese Unexamined Patent Publication (Kokai) No. 61-270,398 discloses a plated steel strip having a plating layer comprising co-deposited zinc and chromium, thus exhibiting an enhanced resistance to corrosion. However, the content of chromium in the plating layer is very small, and thus the corrosion resistance of the resultant plated steel strip is unsatisfactory.

In conventional co-deposition method of zinc and chromium from an electric plating liquid containing zinc ions and trivalent chromium ions, chromium can be co-deposited in a very small amount of 0.005 to 5% based on the total weight of the co-deposited zinc and chromium. An increase in the concentration of the trivalent chromium ions in the plating liquid does not increase the content of chromium in the resultant co-deposited zinc-chromium alloy plating layer, and results in a decreased adhesion of the resultant zinc-chromium alloy plating layer to the steel strip substrate and in a remarkably decreased electric current efficiency.

Accordingly, the conventional zinc-chromium alloy plating method can not be industrially utilized.

Japanese Examined Patent Publication (Kokoku) No. 58-56039 discloses that, when a zinc-chromium alloy containing 10 to 100 ppm of chromium is plated from an acid zinc plating liquid, the resultant plating layer surface has a pearl-like gloss.

Also, an increase in the content of chromium should result in an increase in the corrosion resistance of the resultant plated steel strip. However, it has been found that when the content of chromium in the zinc-chromium alloy plating layer is increased to a level of more than 1% by weight, the resultant plating layer becomes dark grey in color and exhibits uneven strip-shaped patterns, due to the increase in the content of chromium. Therefore, the plated steel strip having a zinc-chromium alloy-plating layer containing 1% by weight of chromium is useless as a commercial product. The production of a zinc-chromium alloy plating layer having both a pearl-like gloss and an enhanced corrosion resistance is very difficult.

Further, it has been found that the increase in the content of chromium in the zinc-chromium alloy plating layer results in a decrease in the phosphate coating layer-forming property of the plating layer That is, when a phosphate chemical conversion treatment is applied to the zinc-chromium alloy plating layer, a large content of chromium in the resultant plating layers, causes the resultant plating layer to exhibit a significantly decreased adhesion property to phosphate membrane. Accordingly, even if a painting layer is formed on the zinc-chromium alloy plating layer, the increase in the corrosion resistance of the resultant plated steel strip is unsatisfactory.

Japanese Unexamined Patent Publication (Kokai) Nos. 60-50179 and 58-98172 discloses a plated steel strip having a zinc, zinc-nickel alloy or zinc-iron alloy plating layer. The conventional plated steel strip is usually coated with an organic paint layer having a thickness of 0.5 to 2.5 μm. The organic paint layer is effective for enhancing the corrosion resistance of the plated steel strip, but when the organic paint layer is cracked, the corrosion resistance of the plated steel strip is borne only by the plating layer. Therefore, the duration of the corrosion resisting activity of conventional plating layer is unsatisfactory.

Japanese Unexamined Patent Publication (Kokai) No. 61-270398 discloses an iron-zinc alloy surface plating layer formed on a zinc-based base plating layer. This iron-zinc alloy surface plating layer effectively increases the corrosion resistance of a paint-coated steel strip. However, when the iron-zinc alloy plating layer is formed on a zinc-chromium alloy base plating layer, the corrosion potential of the zinc-chromium alloy base plating layer is lower than that of the iron-zinc alloy plating layer, and thus the resultant plated steel strip sometimes exhibits an unsatisfactory corrosion resistance under a certain corrosion circumstance.

To produce a zinc-chromium alloy plating layer containing more than 5% by weight of chromium, it is important to maintain the contents of zinc ions ($Zn^{2+}$) and chromium ions ($Cr^{3+}$) in a plating liquid at a necessary high level.

When chromium ions ($Cr^{3+}$) are fed in the form of chromium sulfate or chromium chloride into the plating liquid, the content of sulfate ions ($SO_4^{2-}$) or chlorine ions ($Cl^-$) in the plating liquid is increased, and this large content of sulfate ions or chlorine ions disturbs the smoothness of the plating procedure. Chromium ions ($Cr^{3+}$) cannot be fed in the form of chromium oxide ($Cr_2O_3$) or metallic chromium, because they are not soluble in an acid plating liquid even when the liquid has a pH of 1.0 or less.

Chromium ions ($Cr^{3+}$) may be fed into the plating layer in the form of chromium hydroxide ($Cr(OH)_3$) or chromium carbonate ($Cr_2(CO_3)_2$), but they are only partly dissolved in the plating liquid and the non-dissolved portion thereof deposits from the plating liquid, because the hydroxide and carbonate of chromium are easily oxidized with air into chromium oxide which is insoluble in the plating liquid. Prevention of the oxidation of the chromium hydroxide and carbonate is possible but is very expensive, and thus is not industrially practical.

It is also possible to use a soluble anode consisting of metallic chromium to feed chromium ions ($Cr^{3+}$) from the anode. However, in this method, metallic chromium anode is electrically dissolved in a much larger amount than a necessary amount for plating a cathode and, therefore, the content of the chromium ions ($Cr^{3+}$) in the plating liquid cannot be maintained at a constant level.

Accordingly, the provision of a method effective for continuously feeding chromium ions ($Cr^{3+}$) and for maintaining the content of the chromium ions ($Cr^{3+}$) in the plating liquid at a required constant level is strongly desired.

SUMMARY OF THE INVENTION

An object of the present invention is to provide a corrosion resistant plated steel strip having an excellent resistance to rust and a method for producing the same.

Another object of the present invention is to provide a corrosion resistant plated steel strip provided with a zinc-chromium alloy plating layer containing more than 5% by weight of chromium and having a good gloss and appearance, and a method for producing the same.

Still another object of the present invention is to provide a corrosion resistant plated steel strip provided with a zinc-chromium alloy plating layer firmly bonded to a steel strip substrate and a method for producing the same in a high efficiency.

Further object of the present invention is to provide a corrosion resistant plated steel strip provided with a zinc-chromium alloy plating layer having an enhanced bonding property to a phosphate chemical conversion membrane layer and to a paint coating layer, and a method for producing the same.

A still further object of the present invention is to provide a corrosion resistant plated steel strip useful as a paint coated steel strip having an excellent resistance to corrosion and rust, and a method for producing the same.

The above-mentioned objects can be attained by the corrosion resistant plated steel strip of the present invention which comprises a substrate consisting of a steel strip and at least one principal plating layer formed on at least one surface side of the steel strip substrate and comprising a co-deposited zinc-chromium based alloy comprising chromium in an amount of more than 5% by weight but not more than 40% by weight and the balance consisting of zinc.

The co-deposited zinc-chromium based alloy may be a zinc-chromium-iron family metal alloy comprising more than 5% by weight of chromium, 5% by weight or more of at least one iron family metal, the total amount of the chromium and the iron family metal being 40% by weight or less, and the balance consisting of zinc.

The above-mentioned corrosion resistant plated steel strip can be produced by the method of the present invention which comprises forming, on at least one surface side of a substrate consisting of a steel strip, a principal plating layer comprising a zinc-chromium based alloy by a co-deposition electroplating procedure using an acid plating liquid containing zinc ions and trivalent chromium ions in an adequate amount.

The acid plating liquid may further contain, in addition to the chromium ions and the zinc ions, ions of at least one iron family metal in an amount adequate for causing the resultant principal plating layer to comprise more than 5% by weight of chromium, 5% by weight of at least one iron family metal, the total amount of the chromium and iron family metal being 40% by weight or less, and the balance consisting of zinc.

The steel strip substrate is directly coated with the principal plating layer. Alternatively, the steel strip substrate is directly coated with an additional plating metal layer and then with the principal plating layer. Otherwise, the principal plating layer is coated with an additional plating metal layer.

DESCRIPTION OF THE PREFERRED EMBODIMENTS

Figure 1:
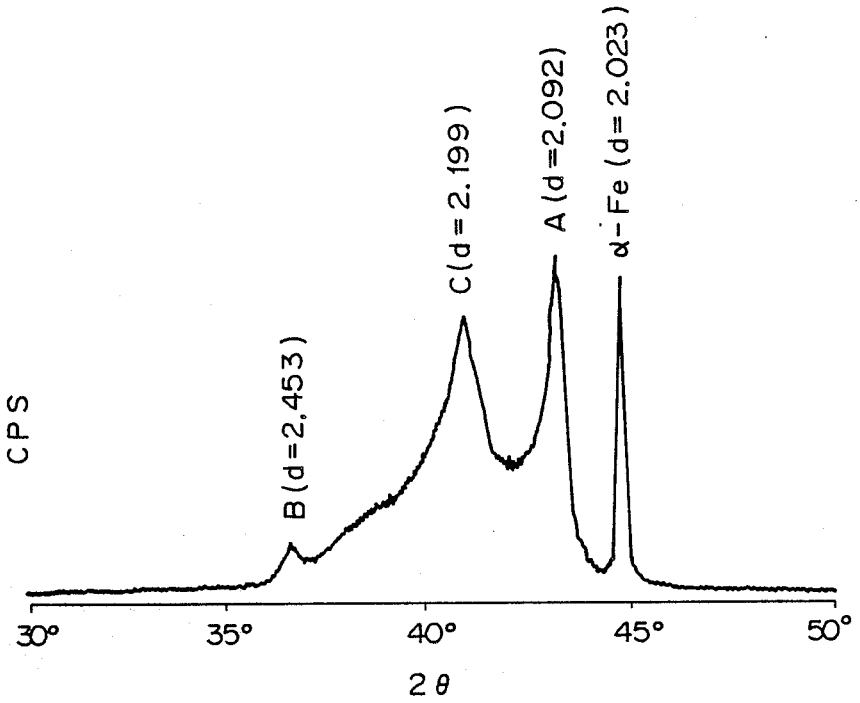
FIG. 1 shows an X-ray diffraction pattern of an embodiment of the zinc-chromium alloy-plating layer of the plated steel strip of the present invention, which embodiment contains the $\eta$ phase.

In the plated steel strip of the present invention, at least one surface of a substrate consisting of a steel strip is coated with a specific zinc-based alloy-principal plating layer. The specific zinc-based alloy can be selected from (1) co-deposited zinc-chromium alloys comprising more than 5% by weight but not exceeding 40% by weight, preferably 7% to 40% by weight, of chromium and the balance consisting of zinc, and (2) co-deposited zinc-chromium-iron family metal alloys comprising more than 5% by weight of chromium, 5% by weight or more of at least one member selected from iron family metals, namely, iron nickel and cobalt, the total amount of the chromium and the iron family metal being 40% by weight or less, and the balance consisting of zinc.

It is known that chromium is in the passive state in the presence of oxygen, and thus exhibits an excellent resistance to corrosion in a diluted acid aqueous solution. However, when chromium is brought into contact with zinc, the chromium exhibits a low electrochemical potential close to that of zinc and, therefore, the zinc-chromium alloy plating layer exhibits a self-sacrificing corrosion resistance. When the zinc-chromium alloy-plating layer is corroded in a wet condition, the resultant corrosion product is assumed to be a basic chloride of trivalent chromium which is a water insoluble multinucleus complex. This corrosion product can serve as a corrosion resistance material for the steel strip substrate.

Accordingly, the chromium-containing zinc-based alloy principal plating layer of the present invention can exhibit a superior corrosion and rust resistance which cannot be attained by a conventional plating layer comprising a zinc-iron alloy or zinc-nickel alloy.

In the zinc-based alloy principal plating layer of the present invention, the content of chromium must be more than 5% by weight but not exceeds 40% by weight. If the content of chromium is 5% by weight or less, the resultant plated steel strip exhibits an unsatisfactory corrosion resistant and rust resistance. When the content of chromium is more than 40%, the resultant plated steel strip is disadvantageous in that the resultant plating layer exhibits an unsatisfactory bonding strength to the steel strip substrate, i.e., the resultant plated steel strip exhibits an unsatisfactory anti-powdering property. The zinc-chromium based alloy may further comprise at least one member selected from the group consisting of iron, nickel, cobalt, manganese, aluminum, silicon, molybdenum, copper, tin, titanium and lead.

In the zinc-chromium-iron family metal alloy-plating layer of the present invention, the iron family metal in a content of 5% by weight or more an uniform microstructure is formed in the resultant plating layer. When the plated steel strip is subjected to a phosphate chemical conversion treatment, the zinc-chromium-iron family metal alloy plating layer having the uniform microstructure forms a dense, even phosphate crystal layer thereon. This plated steel strip having a dense, even phosphate crystal layer exhibits an excellent paint-coating property. For the above-mentioned effects, the content of the iron family metal in the plating layer must be 5% by weight or more.

In the method of the present invention, at least one surface side of a steel strip substrate is plated with an acid plating liquid containing zinc ions and trivalent chromium ions ($Cr^{3+}$) or a mixture of trivalent chromium ions with ions of at least one iron family metal to provide a co-deposited zinc-chromium alloy principal plating layer or a co-deposited zinc-chromium-iron family metal alloy plating layer.

In the acid plating liquid, usually, the zinc ions are in an amount of 10 to 150 g/l, the trivalent chromium ions are in an amount of 10 to 100 g/l and the ion family metal ions are in an amount of 10 to 100 g/l.

Usually, the zinc ions and the chromium ions in the acid plating liquid are in the total amount of 0.2 to 3.0 mole/l.

In the formation of a zinc-chromium alloy plating layer of the present invention, the acid plating liquid contains, for example, zinc ions ($Zn^{2+}$) and chromium ions ($Cr^{3+}$) in a total amount of 0.2 to 1.2 mole/l, at least one type of anions selected from sulfate ions and chlorine ions, complex ion-forming agent for the trivalent chromium ions, and 0.2 to 5.0 mole/l of an antioxidant consisting of at least one member selected from, for example, formic acid, formates, amino radicalcontaining organic compounds, for example, amino acids such as glycine, urea, amines and amides.

The acid plating liquid may further contain 4 mole/l or less of an electric conductivity-increasing agent consisting of at least one member selected from ammonium sulfate, ammonium chloride, ammonium bromide and other ammonium halides, alkali metal halides and alkali metal sulfates. The acid plating liquid may still further contain a pH-buffer consisting of at least one member selected from boric acid, phosphoric acid, alkali metal salts and ammonium salts of the above-mentioned acids.

In the acid plating liquid, when the total amount of the zinc ions and chromium ions is less than 0.2 mole/l, the plating efficiency is sometimes unsatisfactory and when the total amount is more than 1.2 moles/l, the plating liquid is saturated, and thus sometimes cannot be applied to plating operation.

When the amount of the antioxidant is less than 0.2 mole/l, the complex ion formation from the trivalent chromium ions and the oxidation-preventing effect are sometimes unsatisfactory. When the amount of the antioxidant is more than 5.0 mole/l, the plating liquid is sometimes saturated, and thus cannot be used for a plating operation. Also, when the amount of the electric conductivity-increasing agent is more than 4 moles/l, the plating liquid is sometimes saturated and becomes unstable.

The plating operation is preferably carried out at a current density of 10 to 300 A/dm$^2$. When the current density is less than 10 A/dm$^2$, the industrial efficiency of the plating operation is sometimes unsatisfactory. Also, when the current density is more than 300 A/dm$^2$, the chromium ions cannot diffuse into the plating interface of the steel strip substrate at a satisfactory diffusing rate, and therefore, discharge of hydrogen ions on the plating interface of the steel strip substrate occurs at a high rate and causes a rapid increase in pH of the plating liquid to an extent such that the pH cannot be controlled by the pH buffer. Due to the above-mentioned phenomena, the plating operation cannot be carried out under ordinary conditions.

The plating liquid may flow at a flow speed of 0 to 200 m/min. The increase in the flow speed of the plating liquid decreases the thickness of interface layer formed between the steel strip substrate surface and the plating liquid. This decrease causes electrodeposition intermediates, for example, $Cr^{2+}$ or $Zn^{2+}$ dissociated from the ligant thereof to flow away from the interface layer, and thus decrease the plating efficiency. These phenomena can be prevented by controlling the contents of the above-mentioned additives to an adequate level to prepare a satisfactory plating layer.

The plating operation is preferably carried out at a temperature of 20° C. to 70° C. A plating temperature of lower than 20° C. sometimes causes an undesirably increased viscosity of the plating liquid and thus, diffusion of ions in the plating liquid is restricted and the plating efficiency is decreased. A plating temperature of higher than 70° C. sometimes causes undesirable dissociation of ligants from chromium complex ions, and thus normal plating procedures cannot be carried out.

In the formation of the zinc-chromium-iron family metal alloy-plating layer, preferably the content of the iron family metal in the plating layer is not more than 0.5 moles/l. If the content of the iron family metal is more than 0.5 moles/l, the chromium complex ion-forming agent and the antioxidant are consumed for forming iron family metal complex ions to an extent such that the chromium complex ion formation is restricted and, therefore, the electrolytic deposition of chromium is hindered.

The zinc-based alloy-plating layer of he present invention preferably further comprises 0.2% to 20% by weight of fine particles of at least one metal oxide dispersed therein. The metal oxide is preferably selected from oxides of silicon, aluminum, zirconium, titanium, antimony, tin, chromium, molybdenum and cerium. The metal oxide fine particles dispersed in the plating layer enhance the corrosion resistance of the plated steel material. The mechanism of enhancement of the corrosion resistance due to the presence of the metal oxide fine particles is not completely clear, but it is assumed that the corrosion product of chromium formed in the plating layer is fixed on the surface of the metal oxide fine particles, to enhance the corrosion and rust resistance of the plating layer.

Also, the presence of the metal oxide fine particles in the acid plating layer promotes the co-deposition of chromium in an amount of more than 5% by weight with zinc and the fine particles.

When the content of the metal oxide fine particles is less than 0.2% by weight, the corrosion resistance-enhancing effect becomes unsatisfactory.

A content of the metal oxide fine particles exceeding 20% by weight is no longer effective for increasing the corrosion resistance of the resultant plated steel strip. Also, an excessively large content of the metal oxide fine particles sometimes results in a decrease in the bonding strength of the plating layer to the steel strip substrate surface.

The metal oxide fine particles preferably have a size of 1 μm or less and use in the form of colloidal particles.

The zinc-based alloy plating layer containing the metal oxide fine particles of the present invention can be produced by using an acid plating liquid containing 20 to 80 g/l of zinc ions, 10 to 70 g/l of chromium ions ($Cr^{3+}$), 2 to 200 g/l, preferably 10 to 100 g/l of at least one type of metal oxide fine particles and, if necessary, 10 to 70 g/l of at least one type of iron family metal ions, at a current density of 50 to 250 A/dm$^2$, preferably 70 to 250 A/dm$^2$, more preferably 120 to 250 A/dm$^2$. The acid plating liquid preferably has a pH of 1.0 to 3.0.

In the plated steel strip of the present invention, the base plating layer is preferably in an amount of 5 to 50 g/m$^2$.

In the plated steel strip of the present invention, the principal plating layer is directly formed on the surface of the steel strip substrate. The principal plating layer may be coated with an additional plating metal layer (surface layer).

Where the plated steel strip of the present invention is coated with a paint or lacquer, especially a cationic electrodeposition paint, the zinc-based alloy principal plating layer is preferably coated with an additional plating metal layer comprising a zinc or a zinc alloy. The zinc or zinc alloy layer as a surface layer is effective for forming a dense phosphate layer when coated by a phosphating procedure, and thus for enhancing a corrosion resistance of a lacquer layer formed on the phosphate layer. Also, the corrosion potential of the zinc or zinc alloy layer is close to that of the Zn-Cr principal plating layer, and thus the zinc or zinc alloy layer is very effective for enhancing the corrosion resistance of the plated steel strip. The zinc alloy comprises zinc, preferably in an amount of 60% by weight or more, and at least one member selected from iron, nickel, cobalt and manganese.

Where iron or an iron-zinc alloy comprising 60% by weight or more of iron and the balance consisting of zinc is plated on the principal plating layer, the resultant additional plating surface layer has an enhanced bonding property to a phosphate chemical conversion membrane and to a cationic electrodeposition paint coating layer, and thus the resultant paint-coated steel strip has a smooth surface without crater-like defects.

The zinc-chromium-iron family metal alloy base plating layer usually has a corrosion potential of −0.9 to −0.8 volt determined in accordance with a calomel electrode standard in a 5% NaCl solution. Also, an additional plating surface layer comprising 60% by weight of iron and the balance consisting of zinc has a corrosion potential of about −0.8 volt determined in the same manner as mentioned above. The corrosion potentials of the above-mentioned base and surface plating layers are close to each other, and thus the combination of the above-mentioned base plating layer and the surface plating layer is very effective for enhancing the corrosion and rust resistances of the plated steel strip.

A base metal layer may be arranged between the substrate and the principal plating layer to firmly bond the principal plating layer to the substrate therewith and thereby increase the corrosion resistance of the resultant plated steel strip. The base metal layer preferably consists essentially of zinc or an alloy of zinc, preferably in an amount of 60% by weight or more, with at least one member selected from Fe, Ni, Co, Al, Mg and Ti.

The additional coating layer preferably has an amount of 1 to 10 g/m$^2$.

The additional coating layer of the present invention may contain, as an additional component, a small amount of at least one member selected from Ni, Cr, Al, P, Cu, Co Mn, Sn, P and Cd.

The surface of the principal plating layer of the present invention preferably has a glossiness of 80 or more, determined in accordance with JIS Z 8741, 60°/60°.

Generally, an acid plating liquid containing zinc ions and trivalent chromium ions exhibits a special electrodepositing property. That is, an increase in the concentration of zinc ions in the plating liquid accelerates the deposition of zinc but sometimes restricts the deposition of chromium. Also, an increase in the proportion of chromium ions ($Cr^{3+}$) in the plating liquid sometimes causes the deposition of zinc to be restricted and hinders the deposition of chromium.

Also, the principal plating layer of the present invention sometimes exhibits an undesirable white grey or black grey color, and has a number of stripe-patterned blocks.

The above-mentioned disadvantages can be removed by adding a polyoxyalkylene compound to the plating liquid. That is, in the plating liquid containing the polyoxyalkylene compound, zinc and chromium can be co-deposited at a high current efficiency. Also, the resultant principal plating layer has an improved glossiness of 80 or more and a good appearance.

Namely, the surface of the principal plating layer has an uniform stainless steel-like silver white color which is different from the milk white color of a zinc-plating layer surface. When a rust-preventing oil or press oil is applied onto the principal plating layer of the present invention, the oil coating layer is glossy and it is easy to detect cracks or scratches formed thereon. However, when the rust-preventing oil or press oil is applied to a conventional zinc-plating layer, the oil layer has no gloss and it is difficult to detect cracks and scratches on the zinc-plating layer. The polyoxyalkylene compound usable for the present invention is of the formulae:

$$R_2—O—(R_1—O)_n—H$$

and $$R_2—(R_1—O)_r—H$$

wherein $R_1$ represents an alkylene radical, $R_2$ represents a member selected from a hydrogen atom, alkyl radicals, a phenyl radical, a naphthyl radical and derivatives of the above-mentioned radicals, and n represents an integer of 1 to 2000.

For example, the polyoxyalkylene compounds usable for the present invention include the following compounds.

Polyoxyethylene (polyethylene glycol)

$$HO—(CH_2—CH_2—O)_n—H$$

n=1 to 2000

Alkyl-polyoxyethylene ether $$R—O—(CH_2—CH_2—O)_n—H$$

n=1 to 2000

R=an alkyl radical of the formula:

$$C_mH_{2m+1}$$

wherein m=0 to 20

Alkylphenyl-polyoxyethylene ether

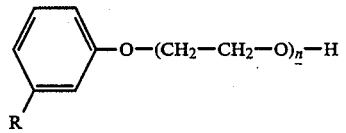

wherein:

n=6 to 2000

R is as defined above m is as defined above

Alkylnaphthyl-polyoxyethylene ether

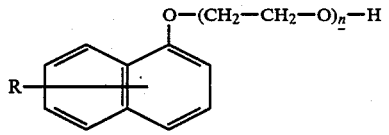

n=4 to 2000

R and m are as defined above.

Polyoxypropylene (polypropyleneglycol)

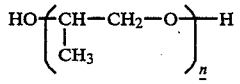

n=3 to 2000

Alkyl-polyoxypropylene ether

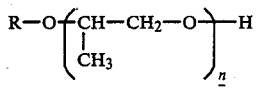

n=1 to 2000

R and m are as defined above.

Alkylphenyl-polyoxypropylene ether

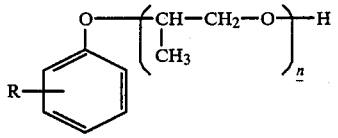

n=6 to 2000

R and m are as defined above.

Alkylnaphthyl-polyoxypropylene ether

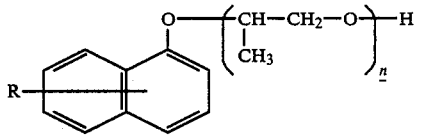

n=4 to 2000

R and m are as defined above.

Polyoxymethylene compound $$R'_1—O—(CH_2—O)_n—H$$

n=3 to 5000

$R'_1$ represents a hydrogen atom, alkyl radical or aryl radical α-ethoxylated naphthol (EN)

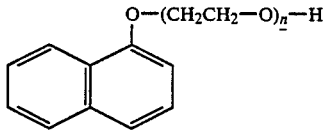

n=1 to 20 and

Ethoxylated-α-naphthol sulfonic acid (ENSA)

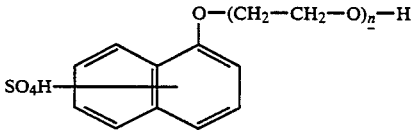

n=1 to 20

Preferably, the polyoxyalkylene compound is added in an amount of 0.01 to 20 g/l of the plating liquid.

When the polyoxyalkylene compound is used as an additive, the plating procedure is preferably carried out by using an acid plating liquid containing 10 to 150 g/l of zinc ions, 10 to 150 g/l of chromium ions ($Cr^{3+}$), 0.01 to 20 g/l of the polyoxyalkylene compound at a pH of 3 to 0.5 at a current density of 50 A/dm$^2$ or more, more preferably 50 to 250 A/dm$^2$ at a temperature of 40° C. to 70° C. Also, the plating liquid preferably is circulated at a flow speed of 30 to 200 m/min.

In an embodiment of the present invention, the principal plating layer comprising a zinc-chromium alloy comprising more than 5% by weight but not exceeding 40% by weight of chromium and the balance consisting of zinc is prepared by an electroplating operation in an acid plating liquid containing 10 to 150 g/l of zinc ions and 10 to 100 g/l of trivalent chromium ions ($Cr^{3+}$), the total concentration of the zinc ions and the trivalent chromium ions being in the range of from 0.5 to 3.0 mole/l, at a current density of 150 A/dm$^2$ to 300 A/dm$^2$.

The acid plating liquid contains acid ions such as sulfate ions and/or chlorine ions and preferably has a pH of 0.5 to 3.0. Also, the acid plating liquid may contain an electroconductivity-increasing agent consisting of at least one selected from, for example, $Na^+$, $K^+$, $NH_4^+$ and $Mg^{2+}$ ions which does not co-deposit with zinc and chromium on the substrate surface. Further, the plating liquid may contain a small amount of at least one type of additional metal ions, for example, $Cr^{+6}$, Ni, Co, Fe, Mn, Cu, Sn, Cd, Al, Mg, Si, Mo, Ti, and Pb ions, which are co-deposited with zinc and chromium. One or more of Al, Mg, Si, Mo and Ti may also be co-deposited with the zinc and chromium.

The plating liquid preferably has a temperature of 40° to 70° C. and is circulated at a flow speed of 30 to 200 m/min.

In an embodiment of the present invention, the base plating layer of the plated steel strip is coated with a chromate layer. The chromate coating layer is preferably coated with a resin layer.

The chromate coating layer can be formed on the base plating layer by any conventional chromate treatment method, for example, coating type chromate treatment, reaction type chromate treatment, and electrolysis type chromate treatment.

In the coating type and reaction type chromate treatment methods, the chromate treating liquid contains $Cr^{+6}$ ions and/or $Cr^{+3}$ and an additive consisting of at least one member selected from inorganic colloids, acids, for example, phosphoric acid, fluorides, and aqueous solutions or emulsion of organic resinous materials.

For example, a typical phosphoric acid and fluoride-containing chromate treating liquid comprises 30 g/l of chromic acid, 10 g/l of phosphoric acid, 4 g/l of titanium potassium fluoride and 0.5 g/l of sodium fluoride. A typical silica-containing chromate treating liquid comprises 50 g/l of chromic acid containing 40% of trivalent chromium and 100 g/l of silica colloid. The inorganic colloid may be selected from silica, alumina, titania, and zirconia colloids. The acid can be selected from oxygen acids, for example, molybdic acid, tungstic acid, and vanadic acid.

The chromate treating liquid preferably contains a substance capable of reacting with zinc to form a water-insoluble substance, for example, phosphoric acid, polyphosphoric acid, and/or another substance which can be converted to a water-insoluble substance by hydrolysis, for example, silicofluorides, titanofluorides, and phosphates.

The inorganic colloids are effective for fixing a small amount of hexavalent chromium in the resultant chromate coating layer, and the phosphoric acid compounds and fluoride compounds are effective for promoting reactions of chromate with base plating layer. The phosphoric acid compound and the silica colloid are used in a concentration of 1 to 200 g/l and 1 to 800 g/l, respectively.

The chromate treating liquids may be mixed with a resinous material which is not reactive with the chromate treating liquid, for example, an acrylic resinous material.

The electrolysis type chromate treatment is carried out by using a treating liquid comprising sulfuric acid, phosphoric acid, and/or halogen ions, and optionally, an inorganic colloid, for example, $SiO_2$ colloid and/or $Al_2O_3$ colloid, and cations, for example, Co and/or Mg ions, in addition to chromic acid.

The electrolytic chromate treatment is usually carried out by a cathodic electrolysis and can be used in conjunction with an anodic electrolysis and/or an alternating current electrolysis.

Generally, the chromate coating layer is in an amount of 5 to 100 mg/m$^2$. A chromate coating layer in an amount of less than 5 mg/m$^2$ sometimes exhibits an unsatisfactory bonding property to a paint coating layer. Also, a chromate coating layer in an amount of more than 100 mg/m$^2$ sometimes causes the resultant chromate coated plated steel strip to exhibit a decreased welding property.

The chromate coating layer is preferably coated with an organic resin coating layer having a thickness of 0.5 to 2.5 μm. The resin is preferably selected from epoxy resins, acrylic polymer resins, polyester resins, polyurethane resins, and olefin-acrylic polymer resins. The organic resin coating layer may contain an additive consisting of at least one member selected from anti-rusting agents, for example, $SiO_2$, a surface tension and viscosity-controlling agent, for example, amino-base surfactant, and lubricants, for example, wax.

A resin coating layer having a thickness of less than 0.5 μm sometimes exhibits an unsatisfactory corrosion resistance-enhancing effect. A resin coating layer having a thickness of more than 2.5 μm sometimes causes the resultant resin coated plated steel strip to exhibit a poor welding property, a reduced cationic electrodeposition paint-coating property, and a poor pressing workability.

In an embodiment of the plated steel strip of the present invention, the principal plating layer comprising a zinc-chromium alloy is coated with an additional plating layer comprising zinc or a zinc-bast alloy, for example, 60% or more of zinc and the balance consisting of at least one member of iron, nickel, manganese and cobalt. This type of additional plating layer exhibits a good phosphate layer-forming property in an immersion type phosphate chemical conversion treatment. The additional coating layer may contain a small amount (for example, 1% or less) of at least one additional metal selected from Sn, Cd, Al, Pb, Cu, Ag, P, C, O, Sb, B, and Ti.

In an embodiment of the plated steel strip of the present invention, the principal plating layer comprising a zinc-chromium alloy preferably does not contain the η phase.

Stable intermetallic compounds are not known in many types of zinc-chromium alloys, but in view of the X-ray diffraction patterns of the zinc-chromium alloys in the base plating layer, it has been found that the X-ray diffraction patterns have a plurality of unknown peaks spaced from each other with face intervals d values which cannot be identified as a zinc phase (η phase) or a chromium phase. These peaks are assumed to denote a certain type of zinc-chromium alloy phase.

In FIGS. 1 to 5, the axis of the abscissas represents a value (degree) of 2θ at the Cu target and the axis of the ordinates represents the intensity of the X-ray.

FIG. 1 shows an X-ray diffraction pattern of a zinc-chromium alloy plating layer which contains 9% by weight of chromium, and has an η phase.

In FIG. 1, peak A (d=2.10 Å) and peak B (d=2.47 Å) correspond to the η phase, peak C (d=2.21 Å) is assumed to correspond to a zinc-chromium alloy phase, and the peak at d=2.023 Å corresponds to the α-Fe derived from the steel strip substrate.

Figure 2:
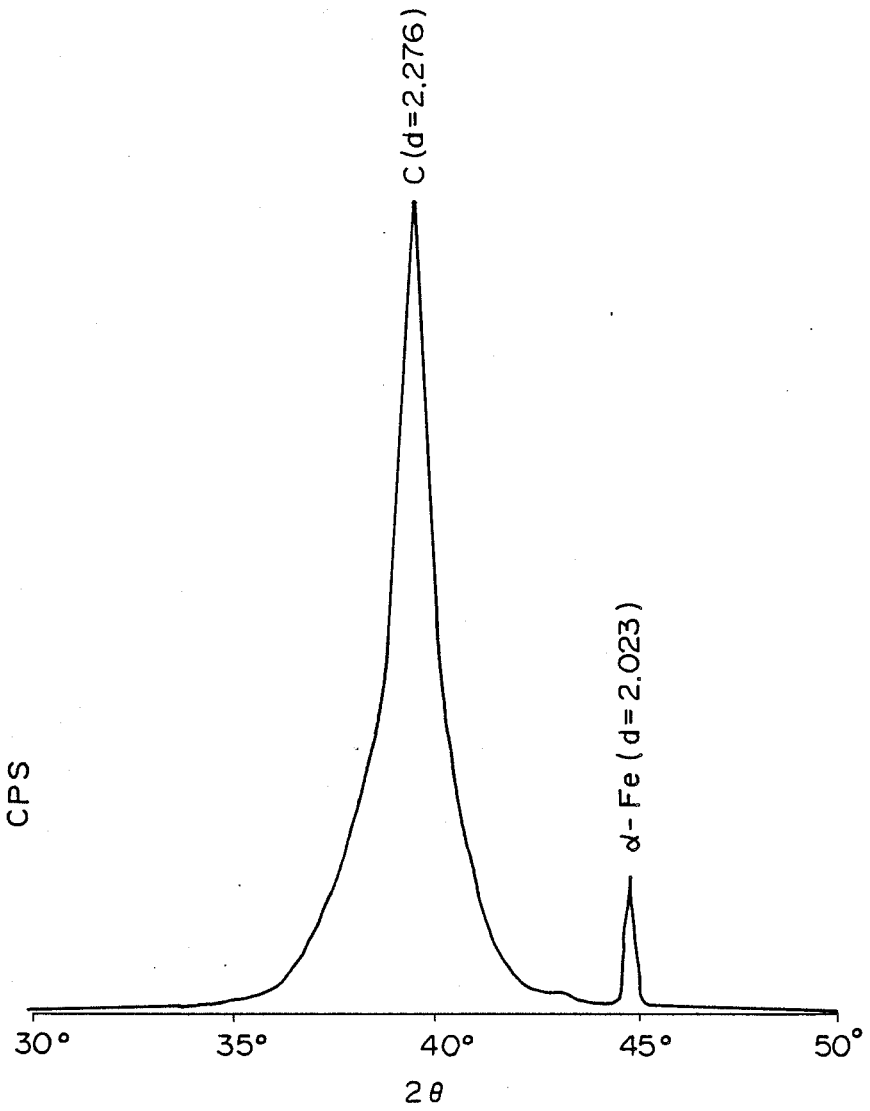
FIGS. 2 to 5 respectively show an X-ray diffraction pattern of another embodiment of the zinc-chromium alloy-plating layer of the plated steel strip of the present invention, which embodiment does not contain the $\eta$ phase.

FIG. 2 shows an X-ray diffraction pattern of a zinc-chromium alloy-plating layer containing 7% by weight of chromium. This pattern has no peak at d=2.10 Å and d=2.47 Å, which correspond to the η phase. The peak C (d=2.276 Å) is assumed to correspond to a type of zinc-chromium alloy phase, and therefore, this zinc-chromium alloy-plating layer does not have the η phase.

Figure 3:
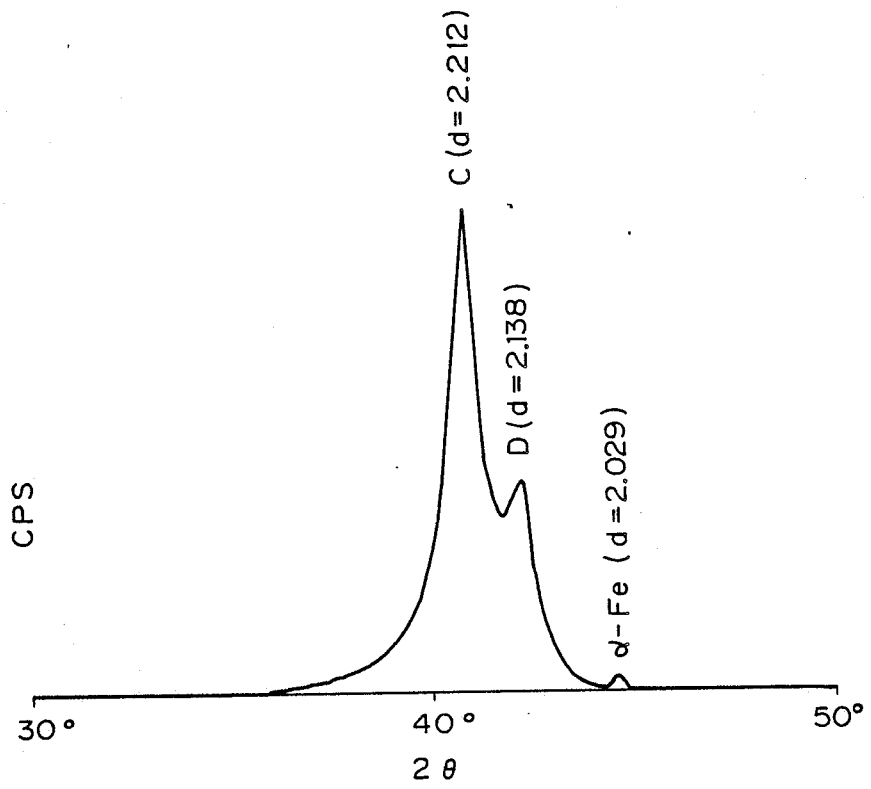

Referring to FIG. 3 in which an X-ray diffraction pattern of a zinc-chromium alloy-plating layer containing 12% by weight of chromium is shown, no peak was found at d=2.10 Å and d=2.47 Å. The peak C (d=2.212 Å) and peak D (d=2.138 Å) are assumed to correspond to certain types of zinc-chromium alloy phases and, therefore, this zinc-chromium alloy-plating layer does not have the η phase.

Figure 4:
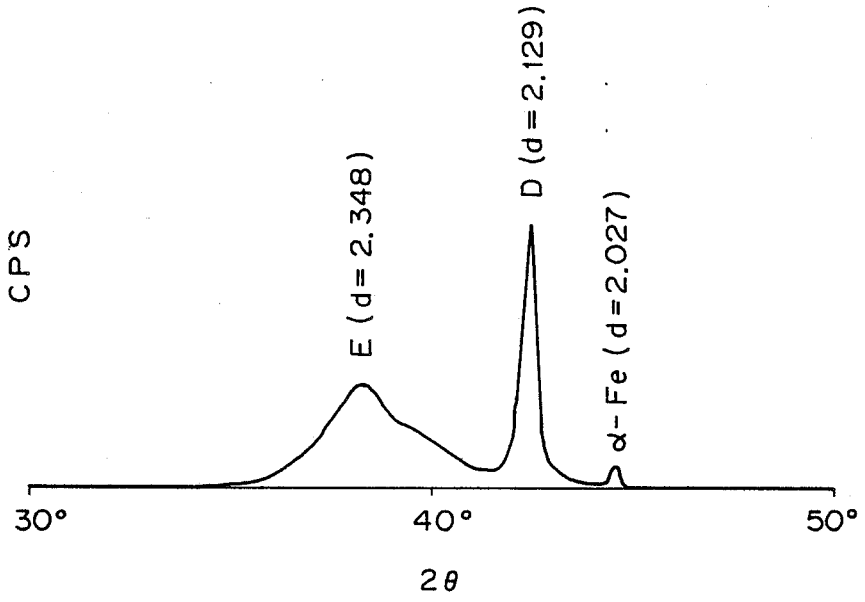

Referring to FIG. 4, in which an X-ray diffraction pattern of a zinc-chromium alloy-plating layer containing 15% by weight of chromium is shown, no peak appeared at d=2.10 Å and d=2.47 Å. The peak D (d=2.129 Å) and peak E (d=2.348 Å) are assumed to correspond to certain types of zinc-chromium alloy phase. In view of FIG. 4, it is clear that this zinc-chromium alloy-plating layer does not have the η phase.

Figure 5:
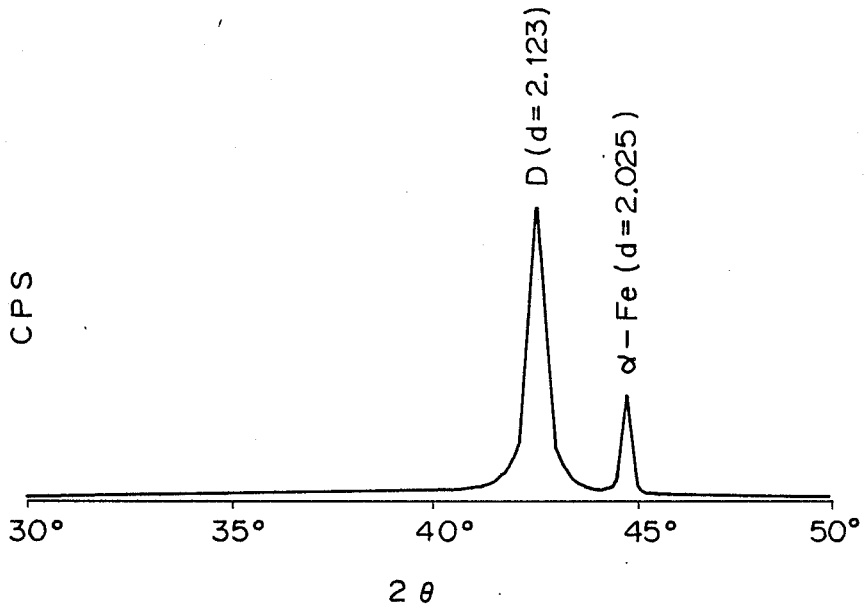

In FIG. 5, in which the X-ray diffraction pattern of a zinc-chromium alloy-plating layer containing 27% by weight of chromium is shown, no peak appears at d=2.10 Å and at d=2.47 Å. The peak D (d=2.123) is assumed to correspond to a certain type of zinc-chromium alloy. From FIG. 5, it is clear that the zinc-chromium alloy-plating layer does not contain the η phase.

The zinc-chromium alloy-plating layer not containing the η phase, as shown in FIGS. 2 to 5, causes the resultant plated steel strip, especially, after paint-coating, to exhibit a higher corrosion and rust resistance than that of the zinc-chromium alloy plating layer containing the η phase. Usually, when the zinc-chromium alloy plating layer is exposed to corrosive conditions, the corrosion product of chromium forms a corrosion resistant membrane on the steel strip substrate surface. The corrosion product produced in the η-phase free zinc-chromium alloy plating layer is effective for restricting an excessive local cell action in the plating layer and for preventing a separation of the paint from the base plating layer. However, the zinc-chromium alloy-base plating layer containing the η phase exhibits lower effect of the above-mentioned restriction and prevention.

The η phase-free zinc-chromium alloy-base plating layer can be produced by electroplating a steel strip substrate with acid plating liquid containing 0.01 to 20 g/l of a polyoxyalkylene derivative as described hereinbefore, at a current density of 50 A/dm$^2$ or more.

When an additional coating layer comprising 60 by weight or more of iron and 40% by weight or less of zinc is formed on the η phase-free zinc-chromium alloy-principal plating layer, the resultant two-layer-plated steel strip exhibits an improved phosphate chemical conversion coating layer-forming property and an enhanced cationic electrodeposition paint coating property layer-forming property, and thus the cation electrodeposition paint-coated steel strip has a smooth coating surface without crater-like coating defect.

In the method of the present invention for producing a zinc-based alloy principal plating layer on a surface of a steel strip substrate, the electroplating procedure can be continuously carried out by continuously feeding zinc ions ($Zn^{2+}$) and trivalent chromium ions ($Cr^{3+}$) to an acid plating liquid in such a manner that a metallic zinc and an aqueous solution containing hexavalent chromium ions ($Cr^{6+}$) are brought into contact with the acid plating liquid containing zinc ions and trivalent chromium ions.

The metallic zinc is dissolved in the acid plating liquid while generating hydrogen gas and is converted to zinc ions. The hexavalent chromium solution, for example, a chromic acid solution, is mixed with the acid plating liquid; the hexavalent chromium promotes the dissolution of the metallic zinc and is converted to trivalent chromium ions.

When the metallic zinc is brought into complete contact with the hexavalent chromium solution, the entire amount of the hexavalent chromium is converted to trivalent chromium ions and no non-converted hexavalent chromium remains.

The metallic zinc can be dissolved in the acid plating liquid by a competitive reaction with $H^+$ ions and with the hexavalent chromium. Therefore, when a base plating layer comprising a zinc-chromium alloy having a high content of chromium is formed, it is necessary to increase the contribution of the reaction with the hexavalent chromium. The reaction rate of the hexavalent chromium is controlled by a rate of diffusion of the hexavalent chromium to the surface of the metallic zinc. Accordingly, it is preferable to use a dissolving vessel which can carry out the contact of the metallic zinc with the hexavalent chromium at a high contact efficiency.

Thus type of dissolving vessel is preferably provided with a hopper for feeding the metallic zinc, a vessel for containing the metallic zinc, means for feeding an aqueous solution of hexavalent chromium into the vessel, and means for circulating an acid plating liquid through the vessel.

When a batch type dissolving vessel is used, the vessel is preferably provided with shaking, stirring or gas-blowing means to increase the contact efficiency. The continuous dissolving vessel can be one of a fluidizing vessel, filling vessel, and tower mill.

In the dissolving vessel for the metallic zinc and hexavalent chromium, preferably the metallic zinc is fixed in the vessel so that the metallic zinc cannot move by the flows of the hexavalent chromium solution and the acid plating liquid or by hydrogen gas bubbles generated on the metallic zinc particle or plate surfaces. For this purpose, a perforated plate is preferably arranged at an upper portion and a bottom portion of the dissolving vessel. The perforated plate allows the acid plating liquid to flow therethrough at a desired flow speed. This flow of the acid plating liquid is effective for enhancing the contact efficiency of the metallic zinc with the hexavalent chromium. The acid plating liquid preferably flows at a space velocity of 0.5 cm/sec or more in the dissolving vessel. In a dissolving vessel in which the metallic zinc is fixed and thus cannot move with the flow of the acid plating liquid, the relative velocity of the acid plating liquid to the metallic zinc is preferably 5 cm/sec or more.

The metallic zinc may be in any shape, for example, plate, grains, or fine particles. In order to allow the acid plating liquid to flow at a satisfactory relative flow speed to the metallic zinc and to have a relatively large surface area thereof, preferably the metallic zinc is in the form of grains or particles having a size of 10 mm to 0.1 mm.

After the reaction in the dissolving vessel has been completed, the residual content of hexachromium ions ($Cr^{6+}$) in the acid plating liquid is preferably less than 10 g/l. Also, the acid plating liquid is preferably introduced into the dissolving vessel at room temperature or more, but not more than 80° C., more preferably 30° C. to 70° C., which is the same as the plating temperature.

The hexavalent chromium-feeding liquid contains chromic acid, dichromic acid and/or chromium chromate, and preferably, does not contain anions and cations other than those mentioned above, to maintain the composition of the acid plating liquid at a constant value.

The chromium chromate is prepared by reacting anhydrous chromic acid with a reducing substance, for example, a lower alcohol compound, for example, ethyl alcohol and propyl alcohol, a polyhydric alcohol, for example, glycerol, and ethylene glycol, an organic acid, for example, formic acid or oxalic acid, or starch or saccharose so that a portion of the hexavalent chromium ($Cr^{6+}$) is reduced to trivalent chromium ($Cr^{3+}$). In the preparation of the chromium chromate solution, the reducing organic substance is used in an amount such that substantially the entire amount of the reducing organic substance added to the chromic acid solution is consumed and substantially no non-reacted substance remains in the resultant chromium chromate solution. The hexavalent chromium feeding liquid may contain a chromate, for example, sodium chromate, in a small amount which does not substantially affect the composition of the acid plating liquid.

In the method of the present invention, preferably a lead-based electrode is used as an insoluble anode, strontium carbonate and/or barium carbonate is fed into the acid plating liquid, and a portion of chromium to be fed into the acid plating liquid consists of chromium sulfate.

The use of an insoluble anode is advantageous in that the shape and dimensions of the anode can be maintained constant even when continuously used for a long period, a distance between a cathode consisting of a steel strip substrate to be plated and the anode can be maintained at a constant value, and therefore, the plating procedure can be continuously carried out under constant conditions.

Also, the distance between the anode and cathode can be shortened so as to reduce a voltage loss generated due to the resistance of the plating liquid. Further, the plating procedure can be continued over a long period without replacement of the anode, and thus provides a high productivity and high economical efficiency.

However, when the insoluble anode is used, the electric current is transmitted by a generation of oxygen gas ($O_2$ due to an electrolysis of water or electrolytic oxidation reaction of components in the plating liquid. In a plating liquid containing zinc ions and trivalent chromium ions, the trivalent chromium ions are oxidized to form hexavalent chromium, and the resultant hexavalent chromium is accumulated in the plating system, and therefore, it is necessary to reduce the hexavalent chromium to produce trivalent chromium ions.

In the above-mentioned method of the present invention, the hexavalent chromium generated due to the insoluble anode is reduced by the metallic zinc fed into the plating liquid, and the concentration of the hexavalent chromium in the plating liquid is maintained at a very low level.

The plating procedure in accordance with the present invention is preferably carried out in a number of plating cells each having an insoluble anode. However, some of the plating cells may have a soluble anode, for example, a chromium anode. The type of anode to be placed in the plating cells can be desired by taking into consideration the contribution of the metallic zinc to the reduction of hexavalent chromium and the consumption of electric current for the oxidation of trivalent chromium on the insoluble anode, so that an undesirable accumulation of hexavalent chromium in the plating liquid is avoided.

The insoluble anode preferably comprises lead, a lead (Pb) based alloys containing at least one member selected from Sn, Ag, In, Te, Tl, Sr, As, Sb and Cu, $PbO_2$, Pt, Pt-based alloys containing at least one member selected from Ir, Pd, Ru and Ph, oxides of Rh and Ru, or a Ta-based amorphous alloy containing at least one member selected from Ru, Rh, Pd, Ir, Pt and Ni.

The most economical insoluble anode is one formed of a Pb or a Pb-based alloy.

The insoluble anode is used mainly in a sulfate-containing plating liquid in which a small amount of Pb is dissolved. The concentration of Pb dissolved in the plating liquid is preferably restricted to a level of 3 ppm or less, to prevent an undesirable decrease in the bonding property of the resultant zinc-chromium alloy plating layer to the steel strip substrate. The increase in the concentration of Pb in the plating liquid can be prevented by adding Sr carbonate and/or Ba carbonate to the plating liquid. When Sr or Ba carbonate is converted to Sr or Ba sulfate, which is insoluble in water, in the plating liquid, the deposition of the resultant sulfate causes Pb dissolved in the plating liquid to be co-deposited therewith. Also, the Sr or Ba carbonate is effective for eliminating an excessive amount of sulfate ions from the plating liquid. This allows chromium to be fed in the form of sulfate, for example, $Cr^2(SO_4)_3$ or $Cr(OH)(SO_4)$ to the plating liquid and the amount of metallic zinc to be added to the plating liquid to be reduced.

The method of the present invention will be further explained below.

Figure 6:
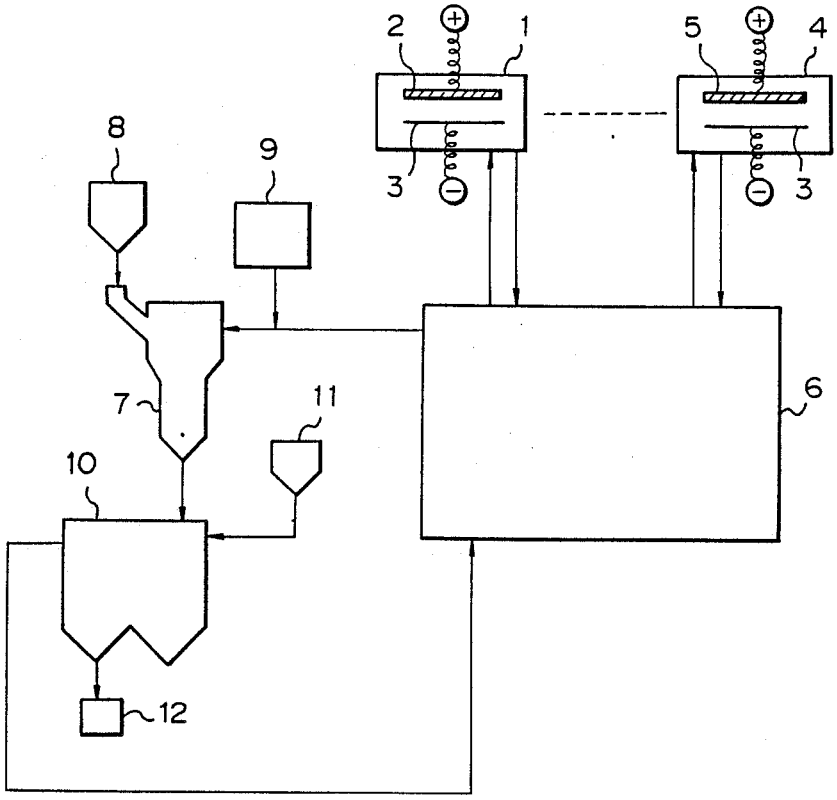
FIG. 6 shows an embodiment of apparatus for continuously carrying out the method of the present invention.

Referring to FIG. 6, a plating apparatus comprises at least one plating cell 1 having an insoluble anode 2 and at least one another plating cell 4 having a soluble anode 5. In each of the cells 1 and 4, a steel strip substrate 3, which serves as a cathode, is plated with a plating liquid. The plating liquid is circulated through a tank 6 and the cell 1 or 4. Metallic zinc is fed from a hopper 8 into a dissolving vessel 7, a portion of the plating liquid is fed from the tank 6 into the dissolving vessel, and hexavalent chromium is fed from a tank 9 into the dissolving vessel 7 to be mixed with the plating liquid. In the dissolving vessel 7, the hexavalent chromium comes into contact with the metallic zinc and is converted to trivalent chromium ions, and a portion of the metallic zinc is converted to zinc ions dissolved in the plating liquid. The resultant plating liquid is fed from the dissolving vessel 7 to a deposition vessel 10, and Sr or Ba carbonate is fed from a hopper 11 to the deposition vessel 10 to eliminate excessive amounts of Pb and sulfate ions. The resultant deposits are removed through a filter 12 to the outside of the plating system. The filtered plating liquid is fed from the deposition vessel 10 to the plating liquid tank 6, and then into the plating cells 1 and 4.

Additional amounts of zinc and chromium corresponding to the consumption thereof in the plating cells are prepared in the dissolving vessel 7 and are fed into the tank 6 so that the concentrations of zinc and chromium are maintained at a constant value.

Figure 7:
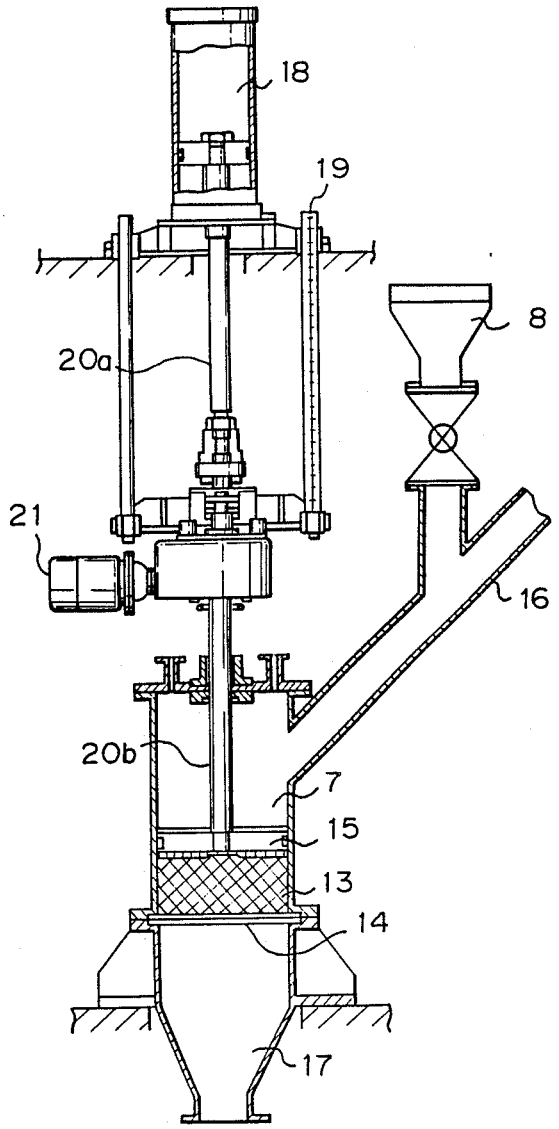
FIG. 7 is a cross-sectional view of an embodiment of the dissolving vessel usable for the apparatus as shown in FIG. 6; and, FIG. 8 shows an another embodiment of the apparatus for continuously carrying out the method of the present invention.

FIG. 7 shows a cross-sectional view of a dissolving vessel useful for the method of the present invention, in which metallic zinc is fixed so that the metallic zinc is not moved by a flow of a liquid containing hexavalent chromium.

Referring to FIG. 7, grains of metallic zinc are charged from a hopper 8 into a dissolving vessel 7 through a duct 16 so that a layer 13 consisting of the metallic zinc grains is formed on a perforated bottom plate 14 while a perforated upper plate 15 is elevated by a plate-moving device comprising a motor 18, guide bar 19, rod **20*a* and rod 20*b*. When the metallic zinc grain layer 13 is formed, the upper plate 15 is placed on the layer 13 and is rotated by a motor 21 so that the upper face of the layer 13 becomes smooth and horizontal. Then the upper plate 15 is fixed on the metallic zinc grain layer 13 so that the metallic zinc grains are fixed between the upper and bottom plates 15 and 14**.

A mixture of the plating liquid with a solution of hexavalent chromium is fed to the dissolving vessel 7 through the conduit 16. The mixture is passed through the metallic zinc grain layer 13 between the perforated bottom and upper plates 14 and 15 while the hexavalent chromium is converted to trivalent chromium ions and the metallic zinc is converted to zinc ions.

The resultant fresh plating liquid is discharged from the dissolving vessel 17 through a discharging conduit 17 and is fed to the deposition vessel (not shown in FIG. 7).

The above-mentioned method of the present invention can be carried out in the presence of the organic reducing substance mentioned above, added to the plating liquid. The organic reducing substance is preferably selected from lower monohydric alcohols, for example, ethyl alcohol and propyl alcohol, polyhydric alcohols, for example, glycerol and ethyleneglycol, reducing lower aliphatic acids, for example, formic acid and oxalic acid, and starch and saccharose.

The reducing organic substance is preferably contained in a concentration of 50 g/l or less preferably, 0.1 to 30 g/l in the plating liquid. If the concentration of the reducing organic substance is more than 50 g/l, the resultant zinc-based alloy plating layer sometimes exhibits an unsatisfactory bonding strength to the steel strip substrate.

The plating liquid containing the reducing organic substance preferably further contains bromine ions ($Br^-$). The bromine ions ($Br^-$) in the plating liquid are preferentially oxidized before the trivalent chromium ions ($Cr^{3+}$) on the insoluble anode and are converted to $Br^2$. The resultant $Br^2$ reacts with the reducing organic substance and is returned to $Br^-$. During the above-mentioned activity, the bromine ions ($Br^-$) in the reducing organic substance-containing plating liquid serves as a catalyst for preventing an undesirable generation of hexavalent chromium on the insoluble anode. The bromine ions may be added in the form of a alkali or ammonium salt, NaBr, KBr, or $NH_4Br$.

Generally, the concentration of bromine ions in the plating liquid is 40 g/l or less.

Figure 8:
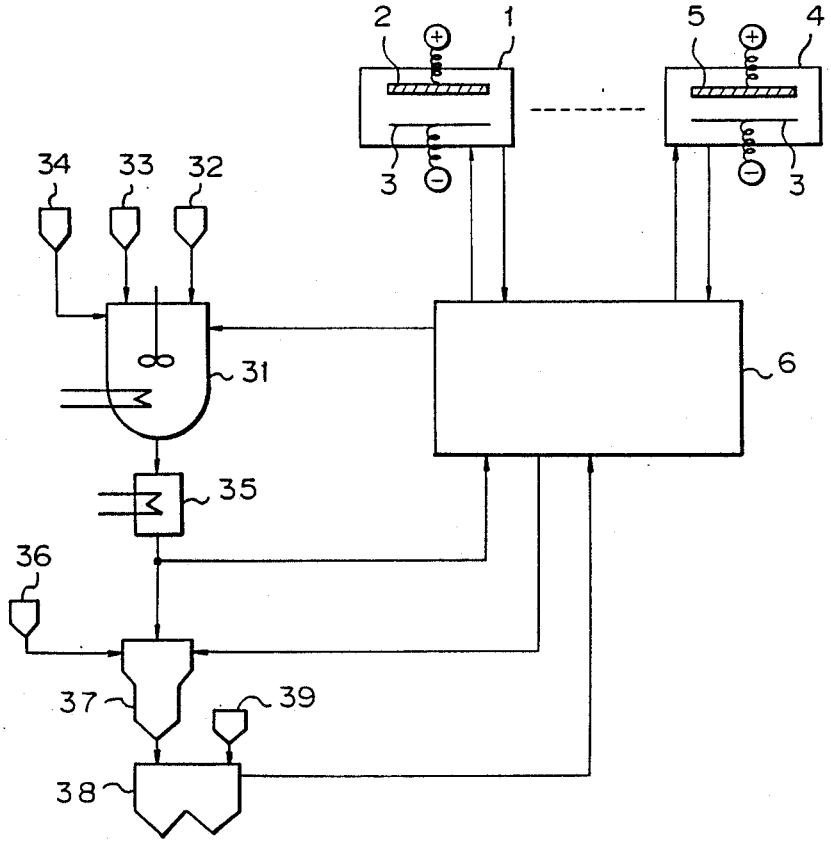

The plating liquid containing the reducing organic substance and Bromine ions can be prepared by using, for example, an apparatus as shown in FIG. 8.

Referring to FIG. 8, a portion of a plating liquid contained in a tank 6 is fed into a reaction vessel 31, and a hexavalent chromium solution in a tank 32, a reducing organic substance in a tank 33 and, if necessary, a sulfuric acid solution in a tank 34 are fed into the reaction vessel 31. In this reaction vessel 31, the hexavalent chromium is reduced to trivalent chromium ions, the resultant plating liquid is controlled to a desired temperature in a heat exchanger 35, and, if necessary, is returned to the tank 6. The heat-exchanged plating layer is fed to a dissolving vessel 37 and is brought into contact with metallic zinc supplied from a hopper 36 to the dissolving vessel 37. Also, a portion of the plating liquid in the tank 6 is fed to the dissolving vessel 37. The metallic zinc is converted to zinc ions and is dissolved in the plating liquid. Also, non-reacted hexavalent chromium in the plating liquid is reduced with the metallic zinc and is converted to trivalent chromium ions.

The plating liquid is fed to a deposition vessel 38 and, if necessary, is mixed with a bromine ion solution fed from a tank 39. The plating liquid is then separated from the deposition and returned to the tank 6.

EXAMPLES

The present invention will be further explained by way of specific examples, which are representative and do not in any way restrict the scope of the present invention.

In the examples, the resistance of a specimen to corrosion was determined as follows.

(1) Preparation of paint-coated specimen

A specimen consisted of a plated steel strip was subjected to a dipping type chemical conversion treatment with zinc phosphate, and the treated specimen was then coated with a cathodic ED coating layer having a thickness of 20 μm.

(2) Cyclic corrosion test

A specimen was subjected to a cyclic corrosion test (CCT) in which a salt spray test was combined with a drying-wetting-cooling test.

In one cycle test, the specimen was wetted at a temperature of 50° C. and a relative humidity of 85% for 15.5 hours, was dried at a 70° C. for 3 hours, was subjected to a salt spray test at a temperature of 50° C. for 2 hours, was left at room temperature for 2 hours, and then was salt spray-tested at 50° C. for 1.5 hours. The test was repeated 30 times. After the test was completed, a decrease in weight of the specimen due to corrosion and the number of perforations per $dm^2$ formed in the specimen, were measured.

(3) Salt spray test

This test was carried out in accordance with Japanese Industrial Standard (JIS) Z 2371, and the percentage of the area in which red rust was generated, based on the total surface area of specimen was measured.

EXAMPLES 1 TO 16

In each of Examples 1 to 16, a cold rolled steel strip consisting of a continuously cast and box-annealed aluminum-killed steel and having a thickness of 0.8 mm and a width of 15 cm was degreased and pickled in a usual manner and then electroplated with an acid plating liquid having the composition as shown in Table 1 at the current density at the temperature shown in Table 1. The resultant principal plating layer had the composition shown in Table 1.

TABLE 1

| Example No. | Composition of acid plating liquid: $ZnCl_2$ (g/l) | $CrCl_3$—$6H_2O$ (g/l) | $ZnSO_4$—$7H_2O$ (g/l) | $Cr_2(SO_4)_3$—$nH_2O$ (g/l) | HCOOK (g/l) | HCOOH (g/l) | $(NH_2)_2CO$ (g/l) | $NH_2$—$CH_2$COOH (g/l) |
|---|---|---|---|---|---|---|---|---|
| 1 | 0 | 159 | 58 | 0 | 84 | 0 | 0 | 37 |
| 2 | 0 | 106 | 115 | 0 | 84 | 0 | 0 | 37 |
| 3 | 27 | 159 | 0 | 0 | 84 | 0 | 0 | 37 |
| 4 | 0 | 0 | 20 | 200 | 0 | 0 | 216 | 0 |
| 5 | 40 | 132 | 0 | 0 | 84 | 0 | 0 | 37 |
| 6 | 0 | 159 | 27 | 0 | 84 | 5 | 0 | 37 |
| 7 | 0 | 159 | 27 | 0 | 84 | 0 | 0 | 37 |
| 8 | 27 | 159 | 0 | 0 | 84 | 0 | 0 | 37 |
| 9 | 27 | 132 | 0 | 0 | 84 | 0 | 0 | 37 |
| 10 | 27 | 159 | 0 | 0 | 84 | 0 | 0 | 37 |
| 11 | 27 | 150 | 0 | 0 | 84 | 0 | 0 | 37 |
| 12 | 40 | 132 | 0 | 0 | 84 | 0 | 0 | 37 |
| 13 | 40 | 132 | 0 | 0 | 84 | 0 | 0 | 37 |
| 14 | 40 | 132 | 0 | 0 | 84 | 0 | 0 | 37 |
| 15 | 27 | 159 | 0 | 0 | 84 | 0 | 0 | 37 |
| 16 | 32 | 132 | 0 | 0 | 84 | 0 | 0 | 37 |

| Example No. | Composition of acid plating liquid: $NH_4Cl$ (g/l) | $NH_4Br$ (g/l) | $H_3BO_3$ (g/l) | Other additive: Type | Amount (g/l) | Plating condition: Current density ($A/dm^2$) | Plating temperature (°C.) | Composition of principal plating layer (%) |
|---|---|---|---|---|---|---|---|---|
| 1 | 54 | 11 | 37 | None | | 80 | 40 | Zn 67% Cr 33% |
| 2 | 54 | 11 | 37 | None | | 80 | 45 | Zn 80% Cr 20% |
| 3 | 54 | 11 | 37 | None | | 160 | 45 | Zn 67% Cr 33% |
| 4 | 0 | 0 | 24 | $(NH_4)_2SO_4$ | 316 | 80 | 40 | Zn 60% Cr 40% |
| 5 | 54 | 11 | 37 | None | | 200 | 40 | Zn 65% Cr 35% |
| 6 | 54 | 11 | 37 | None | | 80 | 30 | Zn 70% Cr 30% |
| 7 | 54 | 11 | 37 | NaOH | 4 | 80 | 40 | Zn 64% Cr 36% |
| 8 | 54 | 11 | 37 | $FeCl_2$—$4H_2O$ | 10 | 80 | 40 | Zn 71% Fe 4% Cr 25% |
| 9 | 54 | 11 | 37 | $NiCl_2$—$6H_2O$ | 18 | 80 | 40 | Zn 70% Cr 16% Ni 14% |
| 10 | 54 | 11 | 37 | $CoCl_2$—$6H_2O$ | 3 | 80 | 40 | Zn 70% Cr 29% Co 1% |
| 11 | 54 | 11 | 37 | $MnCl_2$—$4H_2O$ | 10 | 80 | 40 | Zn 70% Cr 29% Mn 1% |
| 12 | 54 | 11 | 37 | $CuCl_2$—$2H_2O$ | 3 | 200 | 40 | Zn 65% Cr 34% Cu 1% |
| 13 | 54 | 11 | 37 | $PbCl_2$ | 1.5 | 200 | 40 | Zn 65% Cr 34% Pb 1% |
| 14 | 54 | 11 | 37 | $SnCl_2$—$2H_2O$ | 10 | 200 | 40 | Zn 65% Cr 30% Sn 5% |
| 15 | 54 | 11 | 37 | $SbCl_3$ | 1.5 | 80 | 40 | Zn 70% Cr 29.5% Sb 0.5% |
| 16 | 54 | 11 | 37 | $H_3PO_2$ | 30 | 40 | 40 | Zn 70% Cr 27% P 3% |

EXAMPLES 17 TO 46 AND COMPARATIVE EXAMPLES 1 TO 7

In each of Examples 17, 19, 34 and Comparative Examples 1 to 4, the same steel strip as that mentioned in Example 1 was plated with a principal plating layer having the composition and the amount as shown in Table 2.

In each of Examples 19, 20, 21, 26 to 33, 38 to 40, and 42 to 46 and Comparative Examples 5, 6 and 7, the same steel strip as that described in Example 1 was plated with a base plating layer having the composition and the amount as shown in Table 2, and then with a surface plating layer having the composition and the amount shown in Table 2.

In each of Examples 22 to 25, 35 to 37 and 42, the same steel strip as that described in Example 1 was plated with a base plating layer, then with an intermediate plating layer, and finally, with a surface coating layer; each layer having the composition and the amount shown in Table 2.

The resultant plated steel strips exhibited the corrosion resistance as indicated in Table 2.

Table 2 clearly indicates that the plated steel strips of the present invention have an enhanced corrosion resistance even if the thickness of the principal plating layer is small, and therefore, are useful for cars, trucks and electric devices.

TABLE 2

| | Composition of plating layer | | | | | | Corrosion resistance of plated steel strip | | | |
|---|---|---|---|---|---|---|---|---|---|---|
| | | | | | | | | | Cyclic corrosion test (30 cycles) | |
| | Amount ($g/m^2$) | | | Composition (wt %) | | | Salt spray test (10 days) | | Number of perforations per $dm^2$ | |
| Example No. | Base layer | Intermediate layer | Surface layer | Base layer | Intermediate layer | Surface layer | % of rust area | Weight decrease ($kg/m^3$) | Diameter of perforations <1 mm | ≧1 mm |
| Example 17 | 20 | — | — | Zn 90%<br>Cr 10% | — | — | 0 | 0.8 | 0 | 0 |
| Comparative Example 1 | 20 | — | — | Zn 100% | — | — | 90 | 2.2 | 1 | 0 |
| Example 18 | 30 | — | — | Zn 93%<br>Cr 7% | — | — | 0 | 0.9 | 0 | 0 |
| Comparative Example 2 | 30 | — | — | Zn 99%<br>Cr 1% | — | — | 50 | 1.8 | 0 | 0 |
| Example 19 | 15 | — | 5 | Zn 85%<br>Fe 15% | — | Zn 80%<br>Cr 20% | 50 | 1.0 | 0 | 0 |
| Comparative Example 3 | 20 | — | — | Zn 85%<br>Fe 15% | — | — | 100 | 2.4 | 5 | 0 |
| Example 20 | 15 | — | 5 | Zn 89%<br>Ni 11% | — | Zn 70%<br>Cr 30% | 0 | 1.6 | 2 | 0 |
| Comparative Example 4 | 20 | — | — | Zn 89%<br>Ni 11% | — | — 30 | 2.7 | 7 | 3 | |
| Example 21 | 15 | — | 3 | Zn 75%<br>Cr 25% | — | Fe 80%<br>Zn 20% | 0 | 0.9 | 0 | 0 |
| Comparative Example 5 | 15 | — | 3 | Zn 85%<br>Fe 15% | — | Fe 80%<br>Zn 20% | 100 | 2.7 | 11 | 0 |
| Example 22 | 15 | 5 | 3 | Zn 85%<br>Fe 15% | Zn 80%<br>Cr 20% | Fe 80%<br>Zn 20% | 50 | 1.6 | 0 | 0 |
| Example 23 | 10 | 10 | 3 | Zn 100% | Zn 85%<br>Cr 15% | Fe 80%<br>Zn 20% | 10 | 1.3 | 0 | 0 |
| Example 24 | 10 | 10 | 3 | Zn 75%<br>Cr 25% | Zn 100% | Fe 80%<br>Zn 20% | 0 | 1.1 | 0 | 0 |
| Comparative Example 6 | 20 | — | 3 | Zn 85%<br>Fe 15% | — | Fe 80%<br>Zn 20% | 100 | 2.4 | 5 | 0 |
| Example 25 | 10 | 10 | 3 | Zn 87%<br>Ni 11% | Zn 70%<br>Fe 4%<br>Cr 25% | Fe 80%<br>Zn 20% | 0 | 1.4 | 0 | 0 |
| Comparative Example 7 | 20 | — | 3 | Zn 87%<br>Ni 11% | — | Fe 80%<br>Zn 20% | 30 | 2.7 | 12 | 0 |
| Example 26 | 10 | — | 10 | Zn 70%<br>Cr 16% | — | Zn 70%<br>Fe 30% | 0 | 0.8 | 0 | 0 |
| Example 27 | 17 | — | 5 | Zn 70%<br>Cr 16%<br>Ni 14% | — | Fe 65%<br>Zn 35% | 0 | 0.7 | 0 | 0 |
| Example 28 | 20 | — | 3 | Zn 70%<br>Cr 27%<br>Mn 1% | — | Fe 80%<br>Zn 20% | 0 | 0.5 | 0 | 0 |
| Example 29 | 20 | — | 3 | Zn 65%<br>Cr 34%<br>Cu 1% | — | Fe 80%<br>Zn 20% | 0 | 0.7 | 0 | 0 |
| Example 30 | 20 | — | 3 | Zn 65%<br>Cr 34%<br>Pb 1% | — | Fe 80%<br>Zn 20% | 0 | 0.6 | 0 | 0 |
| Example 31 | 20 | — | 3 | Zn 65%<br>Cr 30%<br>Sn 5% | — | Fe 80%<br>Zn 20% | 0 | 0.6 | 0 | 0 |
| Example 32 | 18 | — | 1.5 | Zn 70%<br>Cr 39.5%<br>Sb 0.5% | — | Fe 80%<br>Zn 20% | 0 | 0.6 | 0 | 0 |
| Example 33 | 10 | — | 4 | Zn 85%<br>Fe 15% | — | Zn 75%<br>Cr 15%<br>Ni 9%<br>Pb 1% | 10 | 0.7 | 0 | 0 |
| Example 34 | 5 | — | — | Zn 80%<br>Cr 15%<br>Fe 2%<br>Ni 2%<br>Pb 1% | — | — | 0 | 0.8 | 0 | 0 |
| Example 35 | 30 | 5 | 1 | Zn 50%<br>Al 50% | Zn 70%<br>Cr 30% | Fe 70%<br>Zn 30% | 0 | 0.4 | 0 | 0 |

TABLE 2-continued

| Example No. | Composition of plating layer: Amount (g/m²) Base layer | Amount Intermediate layer | Amount Surface layer | Composition (wt %) Base layer | Intermediate layer | Surface layer | Corrosion resistance of plated steel strip: Salt spray test (10 days) % of rust area | Cyclic corrosion test (30 cycles): Weight decrease (kg/m³) | Number of perforations per dm² Diameter of perforations <1 mm | ≧1 mm |
|---|---|---|---|---|---|---|---|---|---|---|
| Example 36 | 10 | 10 | 3 | Pb 95%<br>Sn 5% | Zn 80%<br>Cr 20% | Fe 40%<br>Mn 40%<br>Zn 20% | 0 | 0.4 | 0 | 0 |
| Example 37 | 3 | 10 | 1 | Zn 100% | Zn 65%<br>Cr 35% | Sn 50%<br>Mn 30%<br>Fe 20% | 0 | 0.5 | 0 | 0 |
| Example 38 | 10 | — | 10 | Zn 90%<br>Ni 9%<br>Co 1% | — | Zn 70%<br>Cr 30% | 0 | 0.7 | 0 | 0 |
| Example 39 | 10 | — | 10 | Zn 90%<br>Cr 10% | — | Zn 70%<br>Cr 30% | 0 | 0.5 | 0 | 0 |
| Example 40 | 30 | — | 5 | Al 90%<br>Si 10% | — | Zn 70%<br>Cr 30% | 0 | 0.4 | 0 | 0 |
| Example 41 | 30 | 5 | 3 | Zn 95%<br>Mg 5% | Zn 70%<br>Cr 30% | Fe 80%<br>Zn 20% | 0 | 0.5 | 0 | 0 |
| Example 42 | 30 | — | 8 | Zn 99%<br>Ti 1% | — | Zn 70%<br>Cr 30% | 0 | 0.4 | 0 | 0 |
| Example 43 | 18 | — | 3 | Zn 70%<br>Cr 30% | — | Fe 90%<br>Zn 7%<br>Pb 3% | 0 | 0.4 | 0 | 0 |
| Example 44 | 30 | — | 8 | Zn 95%<br>Fe 3%<br>Sb 2% | — | Zn 75%<br>Cr 25% | 0 | 0.4 | 0 | 0 |
| Example 45 | 30 | — | 10 | Zn 95%<br>Fe 4.5%<br>Mo 0.5% | — | Zn 75%<br>Cr 25% | 0 | 0.4 | 0 | 0 |
| Example 46 | 20 | — | 2 | Zn 70%<br>Cr 30% | — | Cu 70%<br>Zn 30% | 0 | 0.6 | 0 | 0 |

EXAMPLES 47 TO 53 AND COMPARATIVE EXAMPLES 8 TO 10

In Example 47, a cold steel strip having a thickness of 0.6 mm was plated in an acid plating liquid containing 43 g/l of zinc ions ($Zn^{2+}$) 15 g/l of trivalent chromium ions ($Cr^{3+}$), 18 g/l of sodium ions, sulfate ions in an amount corresponding to the metal ions, and 19 g/l of silica colloid at a pH of 2.0, a temperature of 50° C., and a current density of 150 A/dm², while flowing the plating liquid at a flow speed of 60 m/min.

The resultant principal plating layer had the composition and the amount shown in Table 3.

In each of Examples 48 to 53 and Comparative Examples 8 to 10, the same procedures as those described in Example 47, except that the composition of the plating liquid was modified so that the resultant plating layer had the composition and the amount shown in Table 3.

In Example 52, the principal plating layer was coated with a surface plating layer having the composition and the amount shown in Table 3.

The resultant plated steel strip was subjected to corrosion tests.

In the salt spray test, the corrosion resistance was represented by a ratio (%) of an area of the specimen surface which was covered by red rust after salt spray testing for 720 hours, to the entire area of the specimen surface.

Also, a specimen was chemical conversion treated with zinc phosphate and then coated with a cathodic ED paint at a thickness of 20 μm. The paint coated specimen was subjected to a cross-cut salt-spray test for 600 hours. The corrosion resistance of the paint-coated specimen was represented by the maximum width of blisters formed on the surface of the specimen.

Furthermore, the appearance of the cathodic ED paint-coated steel strip was evaluated by a naked eye test and the resultant evaluation was represented as follows.

Excellent—no craters found on the paint coating layer

Good—10 or less paint coating layer craters found per dm²

Bad—more than 10 craters found per dm².

The results are shown in Table 3.

TABLE 3

| Example No. | Principal (base) plating layer: Amount (g/m²) | Composition (%): Cr | Zn | Oxide particle: Type | Amount (%) | Additional metal: Type | Amount (%) | Additional (surface) plating layer: Amount (g/m²) | Composition (%): Zn | Fe | Salt spray test % of rust area | Cross-cut corrosion resistance of paint-coated steel strip (mm) | Appearance of paint-coated steel strip |
|---|---|---|---|---|---|---|---|---|---|---|---|---|---|
| Example 47 | 23 | 15 | 76 | $SiO_2$ | 9 | — | — | — | — | — | 0 | 1.5 | Good |

TABLE 3-continued

| Example No. | Principal (base) plating layer Amount ($g/m^2$) | Composition (%) Cr | Zn | Oxide particle Type | Amount (%) | Additional metal Type | Amount (%) | Additional (surface) plating layer Amount ($g/m^2$) | Composition (%) Zn | Fe | Salt spray test % of rust area | Cross-cut corrosion resistance of paint-coated steel strip (mm) | Appearance of paint-coated steel strip |
|---|---|---|---|---|---|---|---|---|---|---|---|---|---|
| Example 48 | 22 | 10 | 88 | $Al_2O_3$ | 2 | — | — | — | — | — | 0 | 1.5 | Good |
| Example 49 | 20 | 23 | 73 | $TiO_2$ | 4 | — | — | — | — | — | 0 | 1.5 | — |
| Example 50 | 20 | 33 | 61 | $ZrO_2$ | 6 | — | — | — | — | — | 0 | 1.5 | — |
| Example 51 | 25 | 8 | 91.7 | $Cr_2O_3$ | 0.3 | — | — | — | — | — | 0 | 1.5 | — |
| Example 52 | 20 | 12 | 73 | $SiO_2$ | 15 | — | — | 3 | 15 | 85 | 0 | 1.5 | Excellent |
| Example 53 | 25 | 7 | 92 | $SiO_2$ | 1 | — | — | — | — | — | 0 | 1.5 | — |
| Comparative Example 8 | 23 | 3 | 87 | $Al_2O_3$ | 10 | — | — | — | — | — | 90 | 3.5 | Good |
| Comparative Example 9 | 23 | 0 | 100 | — | — | — | — | — | — | — | 100 | 4.5 | Good |
| Comparative Example 10 | 25 | 5 | 93.5 | $Sb_2O_5$ | 0.5 | Ni | 1 | — | — | — | 40 | 1.5 | — |

EXAMPLES 54 TO 61

In each of Examples 54 to 61, the same steel strip as that described in Example 47 was plated in an acid plating liquid having the composition as indicated in Table 4 and under the conditions indicated in Table 4. The resultant plating layer had the composition as indicated in Table 4, and the resultant plated steel strip had the corrosion resistance indicated in Table 4.

TABLE 4

| Example No. | Composition of plating liquid (g/l) | | | | | | | Plating conditions | | | Composition of plating layer (%) | | | | Corrosion resistance Salt spray test (920 hr) % of rust area |
|---|---|---|---|---|---|---|---|---|---|---|---|---|---|---|---|
| | | | Oxide colloid | | | Additional cation | | | | | | | Oxide colloid | | |
| | $Zn^{2+}$ | $Cr^{3+}$ | Type | Amount | Anion | Type | Amount | Current density ($A/dm^2$) | Relative flowing speed of plating liquid (m/min) | Temperature (°C.) | Zn | Cr | Type | Amount | |
| 54 | 44 | 15 | $SiO_2$ | 47 | Sulfate | $Na^+$ | 9 | 150 | 100 | 50 | | 12 | $SiO_2$ | 20 | 0 |
| 55 | 43 | 15 | $SiO_2$ | 19 | " | $Na^+$ | 18 | 150 | 60 | 50 | " | 15 | $SiO_2$ | 9 | 0 |
| 56 | 32 | 25 | $SiO_2$ | 13 | " | $Na^+$ | 15 | 125 | 60 | 50 | " | 7 | $SiO_2$ | 0.4 | 0 |
| 57 | 38 | 32 | $Al_2O_3$ | 10 | " | $NH_4^+$ | 9 | 200 | 100 | 50 | " | 13 | $Al_2O_3$ | Trace | 0 |
| 58 | 31 | 25 | $TiO_2$ | 13 | Sulfate $H_3BO_4$ 20 g/l | $Na^+$ | 15 | 200 | 100 | 50 | " | 22 | $TiO_2$ | 6 | 0 |
| 59 | 31 | 25 | $Al_2O_3$ | 46 | Sulfate | $NH_4^+$ | 9 | 200 | 200 | 50 | " | 17 | $Al_2O_3$ | 15 | 0 |
| 60 | 31 | 25 | $Al_2O_3$ | 15 | Chloride | $Na^+$ | 15 | 200 | 100 | 50 | " | 25 | $Al_2O_3$ | 5 | 0 |
| 61 | 43 | 33 | $SiO_2$ | 13 | Sulfate | $Na^+$ | 15 | 150 | 150 | 50 | " | 32 | $SiO_2$ | 4 | 0 |

EXAMPLES 62 TO 71 AND COMPARATIVE EXAMPLES 11 AND 12 and the glossiness of the plated surface was measured in accordance with JIS Z 8741. The results are shown in Table 5.

TABLE 5

| | Principal (base) plating layer | | | | | | Additional (surface) plating layer | | |
|---|---|---|---|---|---|---|---|---|---|
| | Composition (%) | | | | | | Composition (%) | | |
| | Zn | Cr | Additional metal | Amount (g/m²) | Additive | | Zn | Fe | Amount (g/m²) |
| Example No. | | | | | | | | | |
| 62 | 93 | 7 | — | 20 | ENSA*1 | 0.1 g/l | — | — | — |
| 63 | 90 | 10 | — | 20 | Polyethyleneglycol (n = 3-10) | 15 g/l | — | — | — |
| 64 | 86 | 14 | — | 20 | α-Polyoxymethylene (n = 200-300) | 0.5 g/l | — | — | — |
| 65 | 83 | 17 | — | 20 | Polyethyleneglycol (n = 20-60) | 1 g/l | — | — | — |
| 66 | 77 | 23 | — | 20 | Polyethyleneglycol (n = 1000-1500) | 5 g/l | — | — | — |
| 67 | 69 | 31 | — | 20 | Polyethyleneglycol laurylether | 10 g/l | — | — | — |
| 68 | 63 | 37 | — | 20 | Polyethyleneglycol (n = 20-60) | 2 g/l | — | — | — |
| 69 | 85 | 12 | Fe 3 | 20 | EN*2 0.04, ENSA*1 | 0.06 g/l | — | — | — |
| 70 | 87 | 12 | Ni 1 | 20 | Polyethyleneglycol nonylphenylether | 1 g/l | — | — | — |
| 71 | 79 | 21 | — | 20 | Polyethyleneglycol (n = 20-60) | 2 g/l | 20 | 80 | 3 |
| Comparative Example | | | | | | | | | |
| 11 | 100 | none | — | 20 | — | | — | — | — |
| 12 | 99 | 1 | — | 20 | — | | — | — | — |

| Example No. | Salt spray test (% rust area) | Cross-cut corrosion resistance of paint-coated steel strip (blister width mm) | Appearance of cathodic ED paint-coated steel strip | Degree of glossiness of plated steel strip 60°/60° | Degree of glossiness of plated steel strip 20°/20° | Appearance of plated steel strip |
|---|---|---|---|---|---|---|
| 62 | 0 | 1.5 | — | 133 | 36 | Even |
| 63 | 0 | 1.5 | — | >170 | 36 | " |
| 64 | 0 | 1.5 | — | >170 | 45 | " |
| 65 | 0 | 1.5 | Good | >170 | 47 | " |
| 66 | 0 | 1.5 | — | >170 | 60 | " |
| 67 | 0 | 1.5 | — | >170 | 25 | " |
| 68 | 0 | 1.5 | — | >170 | 53 | " |
| 69 | 0 | 1.5 | — | 108 | 11 | " |
| 70 | 0 | 1.5 | — | 145 | 32 | " |
| 71 | 0 | 1.0 | Excellent | >170 | 42 | " |
| Comparative Example | | | | | | |
| 11 | 100 | 4.5 | Good | 56 | 4 | Even |
| 12 | 90 | 3.5 | Good | 30 | 2 | Strip-like blotches |

Note:
*1ENSA is α-ethoxylated naphthol sulfonic acid.
*2EN is α-ethoxylated naphthol.

In Example 65, the same steel strip as that mentioned in Example 47 was plated in a sulfuric acid plating liquid containing 56 g/l of zinc ions, 44 g/l of trivalent chromium ions, 15 g/l of sodium ions, and 1 g/l of a polyethylene glycol (n=20 to 60) at a pH of 2.0, a temperature of 50° C., a flow speed of the plating liquid of 60 m/min, and a current density of 100 A/dm².

The resultant principal (base) plating layer had the composition and the amount as shown in Table 5.

In each of Examples 62 to 64 and 66 to 71 and Comparative Examples 11 and 12, the same procedures as those described in Example 65 were carried out except that the composition of the plating liquid was modified so that the resultant plating layer had the composition and the amount as indicated in Table 5.

In Example 71, the resultant principal plating layer was coated with an additional surface) plating layer having the composition and the amount shown in Table 5.

The resultant plated steel strip was subjected to the same corrosion tests as described in Examples 47 to 53,

EXAMPLES 72 TO 80 AND COMPARATIVE EXAMPLES 13 TO 16

In each of Examples 72 to 80 and Comparative Examples 13 to 16, the same steel strip as that mentioned in Example 47 was plated in a plating liquid having the composition as indicated in Table 6 and under the plating conditions indicated in Table 6.

The resultant principal (base) plating layer had a amount of 20 g/m² and the composition as shown in Table 6.

The plated steel strips in Examples 72 to 80 exhibited a good degree of glossiness of 80 or more and had an even silver white appearance.

The comparative plated steel strips of Comparative Examples 13 and 16 had a milky white appearance, which is similar to that of a zinc-plated steel strip. The comparative plated steel strips of Comparative Examples 14 and 15 had an uneven grey or black grey appearance.

The plated steel strip was subjected to the salt spray test for 720 hours.

In the plated steel strips of Examples 72 to 80, no red rust was found on the surface thereof, but in the comparative plated steel strips of Comparative Examples 13 and 16, red rust was formed within 24 hours of the salt spray test. In the comparative plated steel strips of Comparative Examples 14 and 15, red rust was formed within 48 hours and 360 hours of the salt spray test, respectively.

TABLE 6

| | Composition of plating liquid | | | | | | | | Plating Condition | | | Composition of plating layer | |
|---|---|---|---|---|---|---|---|---|---|---|---|---|---|
| | $Zn^{2+}$ (g/l) | $Cr^{3+}$ (g/l) | Polyoxyalkylene compound (g/l) | | Cation | pH | Additional metal ion | | Current density ($A/dm^2$) | Relative flow speed of plating liquid (m/min) | Temperature (°C.) | Zn (%) | Cr (%) |
| Example No. | | | | | | | | | | | | | |
| 72 | 56 | 44 | Polyethyleneglycol (n = 20–60) | 1 | Sulfate | 2 | $Na^+$ | 15 | 100 | 60 | 50 | 83 | 17 |
| 73 | 104 | 40 | Polyethyleneglycol (n = 20–60) | 2 | " | 1.3 | $Na^+$ | 14 | 125 | 100 | 50 | 89 | 11 |
| 74 | 91 | 35 | Polyethyleneglycol (n = 3–10) | 15 | " | 1.0 | $Mg^{2+}$ | 23 | 200 | 150 | 50 | 82 | 18 |
| 75 | 102 | 40 | Polyethyleneglycol laurylether | 0.5 | " | 1.3 | — | | 150 | 60 | 50 | 90 | 10 |
| 76 | 27 | 49 | ENSA | 0.1 | " | 2.2 | $Na^+$ | 15 | 150 | 60 | 50 | 93 | 7 |
| 77 | 33 | 64 | Polyethyleneglycol nonylphenylether | 1 g/l | " | 1.5 | $K^+$ | 15 | 150 | 60 | 50 | 72 | 28 |
| 78 | 26 | 49 | Polyethyleneglycol (n = 20–60) | 2 g/l | " | 2.2 | $Na^+$ | 15 | 200 | 60 | 50 | 63 | 37 |
| 79 | 72 | 26 | α-Polyoxymethylene | 0.5 | " | | $Na^+$ | 15 | 70 | 60 | 50 | 91 | 9 |
| 80 | 55 | 43 | Polyethyleneglycol (n = 20–60) | 1 | Chlorine | 1.9 | $Na^+$ | 10 | 100 | 150 | 50 | 91 | 9 |
| Comparative Example | | | | | | | | | | | | | |
| 13 | 102 | 39 | None | | Sulfate | 1.3 | $Na^+$ | 14 | 125 | 100 | 50 | −100 | Trace |
| 14 | 102 | 39 | " | | " | 1.3 | $Na^+$ | 14 | 250 | 100 | 50 | 99 | 1 |
| 15 | 38 | 34 | " | | " | 2.1 | $NH_4^+$ | 9 | 300 | 150 | 50 | 95 | 5 |
| 16 | 38 | 34 | " | | " | 2.1 | $NH_4^+$ | 9 | 100 | 60 | 50 | −100 | Trace |

EXAMPLES 81 TO 85 AND COMPARATIVE EXAMPLES 17 TO 19

In each of Examples 81 to 85 and Comparative Examples 17 to 19, the same steel strip as that described in Example 47 was plated in an acid plating liquid having the composition indicated in Table 7 and under the conditions indicated in Table 7.

The resultant principal plating layer had an amount of 20 g/m$^2$ and the composition as indicated in Table 7.

When subjected to the salt spray test for 720 hours, the plated steel strips of Examples 81 to 85 did not rust, but in the comparative plated steel strips of Comparative Examples 17 to 19, red rust formed within 48 hours of the salt spray test.

TABLE 7

| | Composition of plating liquid | | | | | | | Plating composition | | | Composition of plating layer | |
|---|---|---|---|---|---|---|---|---|---|---|---|---|
| | $Zn^{2+}$ (g/l) | $Cr^{3+}$ (g/l) | $Zn^{2+}+Cr^{3+}$ (mol/l) | Cation | pH | Additional ion | (g/l) | Current density (A/dm$^2$) | Relative flow speed of plating liquid (m/min) | Temperature (°C.) | Zn (%) | Cr (%) |
| Example No. | | | | | | | | | | | | |
| 81 | 27 | 49 | 1.36 | Sulfate | 2.2 | $Na^+$ | 15 | 200 | 50 | 50 | | 13 |
| 82 | 32 | 25 | 1.00 | " | 2.5 | $K^+$ | 9 | 350 | 100 | 50 | " | 37 |
| 83 | 33 | 78 | 2.00 | " | 1.5 | — | | 250 | 50 | 50 | " | 18 |
| 84 | 55 | 43 | 1.67 | Chlorine | 1.9 | $Na^+$ | 10 | 250 | 100 | 50 | " | 7 |
| 85 | 40 | 28 | 1.15 | Sulfate | 2.0 | $NH^+$ | 10 | 250 | 100 | 50 | " | 25 |
| Comparative Example | | | | | | | | | | | | |
| 17 | 102 | 39 | 2.31 | Sulfate | 1.3 | $Na^+$ | 14 | 125 | 100 | 50 | −100 | Trace |
| 18 | 38 | 34 | 1.24 | " | 2.1 | $Na_4^+$ | 9 | 100 | 60 | 50 | −100 | Trace |
| 19 | 45 | 14 | 0.96 | " | 2.2 | $Na^+$ | 9 | 150 | 60 | 50 | 97 | 3 |

EXAMPLES 86 TO 92 AND COMPARATIVE EXAMPLES 20 TO 23

In Example 86, the same cold rolled steel strip as that described in Example 47 was electroplated in a sulfate type plating liquid containing 56 g/l of zinc ions, 44 g/l of trivalent chromium ions, 15 g/l of sodium ions, and 1 g/l of polyethyleneglycol having a molecular weight of 1500, at a pH of 2.0, a temperature of 50° C., a flow speed of the plating liquid of 60 m/min, and a current density of 100 A/dm$^2$.

The resultant plating layer had the amount and the composition indicated in Table 8.

In Each of Examples 87 to 92 and Comparative Examples 20 to 23, the same plating procedures as those described in Example 86 were carried out except that the composition of the plating liquid and the plating conditions were modified so that the resultant plating layer had the composition as indicated in Table 8.

The plated steel strips were subjected to a chromate treatment of the type indicated in Table 8.

(a) The coating type chromate treatment was carried out in such a manner that a chromate treating liquid containing 50 g/l of chromic acid, which contains 40% of trivalent chromium ($Cr^{3+}$), and 100 g/l of $SiO_2$ colloid, was coated on the surface of the plated steel strip by an air-wipe method, and then dried at a temperature of 100° C. for one minute. The amount of the coated treating liquid layer was controlled by controlling the concentration of the treating liquid and by the air-wipe operation.

(b) The reaction type chromate treatment was carried out by coating the surface of the plated steel strip with a treating liquid containing 50 g/l of chromic acid, 10 g/l of phosphoric acid, 0.5 g/l of NaF, and 4 g/l of $K_2TiF_6$ by a roll coater, and by drying the coated treating liquid layer at a temperature of 60° C. The amount of the coated treating liquid layer was controlled by controlling the concentration of the treating liquid and the roll-coating operation.

(c) The electrolysis type chromate treatment was carried out by subjecting the plated steel strip to a cathodic electrolysis treatment with a treating liquid containing 30 g/l of chromic acid and 0.2 g/l of sulfuric acid at a current density of 3 A/dm$^2$, by washing with water, and by drying. The amount of the chromate was controlled by controlling the quantity of electricity (Coulomb) applied to the treating liquid.

The chromate-coated steel strips were coated with the resinous materials as shown in Table 8. The resinous materials contained a rust-preventing agent, for example, $SiO_2$, hardening-promoting agent, catalyst, lubricant, and water-wetting promoting agent. The coating operation with the resinous material was carried out by using a roll coater and the coated resinous material was cured at a temperature of 140° C. to 170° C. for 10 seconds to 30 seconds.

The resin-coated steel strips were subjected to the salt spray test in which a time (hours) in which red rust formed on 2% of the surface area of specimen was measured.

Also, the resin-coated steel strips were drawn with a 10% strain, and then subjected to the same salt spray test as that mentioned above.

The results are shown in Table 8.

TABLE 8

| Example No. | Composition of plating layer (%) Cr | Zn | Iron family metal | Amount (g/m²) | Chromatic layer Type of chromate treatment | Amount (mg/m² of Cr) | Resin layer Type of resin | Thickness (μm) | Corrosion resistance Salt spray test on resin-coated steel strip (hr) | Salt spray test on resin-coated drawn steel strip (hr) |
|---|---|---|---|---|---|---|---|---|---|---|
| Example | | | | | | | | | | |
| 86 | 17 | 83 | — | 20 | Reaction type | 50 | Epoxy | 1.0 | >1000 | >1000 |
| 87 | 16 | 84 | — | 20 | Reaction type | 80 | Acrylic | 1.5 | >1000 | >800 |
| 88 | 8 | 92 | — | 20 | Coating type | 40 | Acrylepoxy | 0.7 | >1000 | >1000 |
| 89 | 36 | 64 | — | 20 | Electrolysis type | 30 | Urethane | 1.2 | >1000 | >1000 |
| 90 | 25 | 75 | — | 20 | Coating type | 50 | Epoxy | 1.2 | >1000 | >1000 |
| 91 | 12 | 86 | Fe 2 | 20 | Reaction type | 60 | Epoxy | 2.0 | >1000 | >1000 |
| 92 | 11 | 88 | Ni 1 | 20 | Electrolysis type | 20 | Olefinacrylic | 1.0 | >1000 | >1000 |
| Comparative Example | | | | | | | | | | |
| 20 | 1 | 99 | — | 20 | Coating type | 50 | Epoxy | 1.0 | >1000 | 300 |
| 21 | — | 85 | Fe 15 | 20 | Reaction type | 50 | Epoxy | 1.0 | >1000 | 300 |
| 22 | — | 89 | Ni 11 | 20 | Electrolysis type | 30 | Epoxy | 1.0 | >1000 | 200 |
| 23 | — | 100 | — | 20 | Coating type | 50 | Epoxy | 1.0 | >1000 | 200 |

EXAMPLES 93 TO 103 AND COMPARATIVE EXAMPLES 24 TO 28

In Example 94, a cold rolled steel strip having a thickness of 0.7 mm was plated in a sulfate type plating liquid containing 76 g/l of zinc ions, 31 g/l of trivalent chromium ions, 25 g/l of iron ions, 12 g/l of sodium ions, and 1 g/l of a polyethyleneglycol having a molecular weight of 1500, at a pH of 1.5, a temperature of 50° C., a flow speed of the plating liquid, and a current density of 100 A/dm². The resultant plating layer had the composition and the amount as indicated in Table 9.

In each of Examples 93 and 95 to 103 and Comparative Examples 24 to 28, the same procedures as those described above were carried out except that the composition of the plating liquid was modified so that the resultant plating layer had the composition as shown in Table 9.

In Examples 102 and 103, the plated steel strip was further plated with an additional (surface) plating layer having the composition and the amount as shown in Table 9.

The resultant plated steel strips were subjected to the following tests.

(a) Salt spray test

This test was carried out in accordance with JIS Z 2371 for 720 hours. A ratio (%) of the rusted area to the entire area of the specimen was determined.

(b) Phosphate chemical conversion treatment

After an ordinary phosphate chemical conversion treatment was applied to a specimen, the density of the resultant phosphate crystals was observed.

(c) Water-proof, paint adhesion test

A specimen was subjected to an immersion type phosphate chemical convertion treatment in a usual manner, and then to a cathodic electrodeposition paint-coating treatment to form a paint-coating layer having a thickness of 20 μm. The paint coated specimen was intermediate coated, water-polished, and upper coated to provide a final coat having a total thickness of 80 μm. The specimen was immersed in water at a temperature of 40° C. for 10 days, and thereafter, was cross-cut to form 100 squares (2 mm×2 mm). An adhesive tape was adhered to the cross-cut surface of the specimen and was peeled from the surface. The number of peeled squares of the coating was counted.

(d) Corrosion test or paint-coated specimen

The phosphate chemical conversion-treated and paint-coated specimen having a thickness of paint-coating layer of 22 μm was cross-cut in the same manner as mentioned above, and was subjected to the salt spray test for 840 hours. The maximum width of blisters formed in the specimen was measured (e) Appearance of paint coated specimen A specimen was subjected to an ordinary phosphate chemical conversion treatment and then to a cathodic electrodeposition paint coating procedure under a voltage of 300 V. The appearance of the resultant paint-coated specimen was observed, and the number of craters formed on the specimen surface was measured.

(f) Powdering property test

This test was carried out in such a manner that an adhesive tape was adhered on a surface of a specimen, and the specimen was folded so that the adhesive tape was on the inside of the folded specimen. Then the specimen was opened and the adhesive tape was peeled from the specimen. The maximum width of a portion of the specimen on which powder of the plating layer was adhered was measured.

The results are shown in Table 9.

TABLE 9

| Example No. | Principal (base) plating layer Composition (%) Zn | Cr | Iron family metal | | Amount (g/m²) | Additional (surface) plating layer Composition (%) Zn | Fe | Additional component | Amount (g/m²) | Plated steel strip: Salt spray test on plated steel strip (% of rusted area) | Phosphate treating property (densiness of crystal) | Water-proof, adhesion property (The number of peeled sequences) | Corrosion resistance of paint-coated specimen (Width mm of blisters) | Appearance of paint-coated specimen (The number of craters) | Powdering property (mm) |
|---|---|---|---|---|---|---|---|---|---|---|---|---|---|---|---|
| Example 93 | 79.5 | 5.5 | Fe | 15 | 20 | — | — | — | — | 40 | Dense | 0 | 2.0 | — | 0–3 |
| Example 94 | 80 | 10 | Fe | 10 | 20 | — | — | — | — | 0 | " | 0 | 1.5 | — | 0–3 |
| Example 95 | 81 | 14 | Fe | 5 | 20 | — | — | — | — | 0 | " | 0 | 1.5 | 1–9 | 0–3 |
| Example 96 | 65 | 25 | Fe | 10 | 20 | — | — | — | — | 0 | " | 0 | 1.5 | — | 0–3 |
| Example 97 | 63 | 7 | Fe | 30 | 20 | — | — | — | — | 0 | " | 0 | 1.5 | — | 0–3 |
| Example 98 | 76 | 12 | Ni | 12 | 20 | — | — | — | — | 0 | " | 0 | 1.5 | 1–9 | 0–3 |
| Example 99 | 65 | 28 | Ni | 7 | 20 | — | — | — | — | 0 | " | 0 | 1.5 | — | 0–3 |
| Example 100 | 76 | 18 | Co | 6 | 20 | — | — | — | — | 0 | " | 0 | 1.5 | — | 0–3 |
| Example 101 | 74 | 11 | Fe | 15 | 20 | — | — | — | — | 0 | " | 0 | 1.5 | — | 0–3 |
| Example 102 | 80 | 14 | Fe | 6 | 20 | 20 | 80 | — | 3 | 0 | " | 0 | 1.0 | 0 | 0–3 |
| Example 103 | 77 | 16 | Ni | 7 | 20 | 20 | 79.5 | P 0.5 | 2 | 0 | " | 0 | 1.0 | 0 | 0–3 |
| Comparative Example 24 | 100 | — | — | | 20 | | — | — | — | 100 | " | >10 | 7.0 | 1–9 | 0–3 |
| Comparative Example 25 | 96 | 1 | Co | 3 | 20 | | — | — | — | 90 | " | >10 | 6.0 | 1–9 | 0–3 |
| Comparative Example 26 | 85 | — | Fe | 15 | 20 | | — | — | — | 100 | " | 1–9 | 3.0 | >10 | 0–3 |
| Comparative Example 27 | 88 | — | Ni | 12 | 20 | | — | — | — | 100 | " | 1–9 | 3.0 | >10 | 0–3 |
| Comparative Example 28 | 55 | 25 | Fe | 20 | 20 | | — | — | — | 0 | " | 0 | 2.0 | — | >3 |

EXAMPLES 104 TO 112 AND COMPARATIVE EXAMPLES 29 AND 30

In Example 111, a cold rolled steel strip having a thickness of 0.7 mm was electroplated in a sulfate type plating liquid containing 56 g/l of zinc ions, 44 g/l of trivalent chromium ions, 15 g/l of sodium ions, and 1 g/l of a polyethylene glycol having a molecular weight of 1500 at a pH of 2.0, a temperature of 50° C., a flow speed of the plating liquid of 60 m/min, and a current density of 100 A/dm$^2$. The resultant base plating layer was plated with a surface plating layer having the composition as indicated in Table 10.

In each of Examples 104 to 110 and 112 and Comparative Examples 29 and 30, the same plating procedures as those described above were carried out except the base plating layer-forming procedures and the surface plating layer-forming procedures were modified so that the resultant base plating layer and the surface plating layer had the compositions indicated in Table 10, respectively.

The plated steel strips were subjected to the same salt spray test, phosphate chemical conversion treatment, and corrosion test for the paint-coated steel strip as described in Example 93, with the following exception.

In the corrosion test for the paint-coated specimen, the cross-cut specimen was exposed to the outside atmosphere. During the exposure, a 5% saline solution was sprayed on the specimen once a week. The exposure was continued for 10 weeks. Thereafter, a maximum width of blisters formed in the specimen was measured.

The results are shown in Table 10.

TABLE 10

| Example No. | Base plating layer Composition (%) Zn | Cr | Additional component | Amount (g/m$^2$) | Surface plating layer Composition (%) Zn | Additional component | Amount (g/m$^2$) | Corrosion resistance: Salt spray test (%) | Phosphate treating property | Corrosion resistance of paint-coated specimen (mm) |
|---|---|---|---|---|---|---|---|---|---|---|
| Example | | | | | | | | | | |
| 104 | 93 | 7 | — | 20 | 80 | Fe 20 | 1 | 0 | Dense crystal | 1.0 |
| 105 | 90 | 10 | — | 20 | 89 | Ni 11 | 2 | 0 | " | 1.0 |
| 106 | 86 | 14 | — | 20 | 100 | — | 2 | 0 | " | 1.0 |
| 107 | 85 | 14 | $SiO_2$ 1 | 20 | 70 | Fe 30 | 1 | 0 | " | 1.0 |
| 108 | 82 | 18 | — | 20 | 95 | Co 5 | 2 | 0 | " | 1.0 |
| 109 | 75 | 25 | — | 20 | 100 | — | 10 | 0 | " | 1.0 |
| 110 | 64 | 36 | — | 5 | 100 | — | 15 | 0 | " | 1.0 |
| 111 | 83 | 17 | — | 20 | 65 | Mn 35 | 3 | 0 | " | 1.0 |
| 112 | 90 | 10 | — | 40 | 100 | — | 5 | 0 | " | 1.0 |
| Comparative Example | | | | | | | | | | |
| 29 | 100 | — | — | 20 | — | — | — | 100 | " | 1.0 |
| 30 | 89 | — | Ni 11 | 20 | — | — | — | 100 | " | 1.5 |

EXAMPLES 113 TO 119 AND COMPARATIVE EXAMPLES 31 TO 35

In Example 113, the same cold rolled steel strip as that mentioned in Example 111 was plated in a sulfate type plating liquid containing 56 g/l of zinc ions, 44 g/l of trivalent chromium ions, 15 g/l of sodium ions, and 1 g/l of polyethyleneglycol having a molecular weight of 1500, at a pH of 2.0, a temperature of 50° C., a flow speed of the plating liquid of 60 m/min, and a current density of 100 A/dm$^2$.

The plated steel strip was subjected to a reaction type chromate treatment to form a chromate layer in an amount of 50 mg/m$^2$.

In each of Examples 114 to 119 and Comparative Examples 31 to 35, the same procedures as those mentioned above were carried out except that the composition of the plating liquid and the plating conditions were modified so that the resultant plating layer had the composition as indicated in Table 11, and the chromate treatment was carried out as shown in Table 11.

(a) Coating type chromate treatment

Same as that described in Examples 86 to 92.

(b) Reaction type chromate treatment

Same as that described in Examples 86 to 92.

(c) Electrolysis type chromate treatment

Same as that described in Examples 86 to 92, except that the treating liquid contained 50 g/l of chromic acid, 0.4 g/l of sulfuric acid, 20 g/l of phosphoric acid, and 11 g/l of zinc carbonate.

The resultant chromate-coated steel strips were subjected to the following corrosion tests.

(a) Salt spray test for chromate-coated specimen

The corrosion resistance was represented by a time in which 2% of the surface area of the specimen was covered with red rust.

(b) Salt spray test for stretched specimen

The same test as mentioned above was applied to a chromate-coated specimen, which was stretched at a 10% strain.

The results are shown in Table 11.

TABLE 11

| Example No. | Plating layer Composition (%) Cr | Zn | Additional component | Amount (g/m$^2$) | Chromate layer: Type of chromate treatment | Amount (mg/m$^2$) | Salt spray test on chromate-coated specimen (hr) | Salt spray test on stretched specimen (hr) |
|---|---|---|---|---|---|---|---|---|
| Example | | | | | | | | |
| 113 | 17 | 83 | — | 20 | Reaction type | 50 | >1000 | >700 |
| 114 | 6 | 94 | — | 20 | " | 80 | >1000 | >700 |

TABLE 11-continued

| Example No. | Plating layer Composition (%) Cr | Zn | Additional component | | Amount (g/m²) | Chromate layer Type of chromate treatment | Amount (mg/m²) | Salt spray test on chromate-coated specimen (hr) | Salt spray test on stretched specimen (hr) |
|---|---|---|---|---|---|---|---|---|---|
| 115 | 8 | 92 | — | | 20 | Coating type | 40 | >1000 | >700 |
| 116 | 36 | 64 | — | | 20 | Electrolysis type | 30 | >1000 | >700 |
| 117 | 25 | 75 | — | | 20 | Coating type | 50 | >1000 | >700 |
| 118 | 12 | 86 | Fe | 2 | 20 | Reaction type | 60 | >1000 | >700 |
| 119 | 11 | 88 | Ni | 1 | 20 | Electrolysis type | 20 | >1000 | >700 |
| Comparative Example | | | | | | | | | |
| 31 | 1 | 99 | — | | 20 | Coating type | 50 | 400 | 100 |
| 32 | — | 85 | Fe | 15 | 20 | Reaction type | 50 | 300 | 50 |
| 33 | — | 89 | Ni | 11 | 20 | Electrolysis type | 30 | 200 | 50 |
| 34 | — | 100 | — | | 20 | Coating type | 50 | 400 | 100 |
| 35 | — | 100 | — | | 20 | Electrolysis type | 30 | 100 | 50 |

EXAMPLES 120 TO 128 AND COMPARATIVE EXAMPLES 36 AND 37

In each of Examples 120 to 128 and Comparative Examples 36 and 37, the same cold rolled steel strip as that described in Example 111 was plated in a sulfate tape plating liquid having the composition, and under the conditions, indicated in Table 12. In Comparative Example 27, a usual zinc plating layer was formed on the steel strip.

The resultant principal plating layers exhibited the X-ray diffraction patterns shown in FIGS. 1 to 5.

The X-ray diffraction patterns were determined by a specimen-rotating method using a Cu target under 45 kV at 150 mA, and at scanning speed of 2 deg./min.

Also, the resultant principal plating layers had the composition and the amount shown in Table 13 and the X-ray diffraction patterns had peaks at the locations as indicated in Table 13.

In Examples 125 to 127, the principal plating layers were coated with additional (surface) plating layers having the compositions shown in Table 13.

The plated steel strip was subjected to the corrosion tests.

Referring to Table 13, the salt spray test was carried out in accordance with JIS Z 2371 for 720 hours, and the result is represented by a ratio (%) of red rusted area to the entire area of the specimen surface. The cyclic corrosion test was carried out by wetting a specimen at a temperature of 50° C. and a relative humidity of 85% for 16 hours, by drying the specimen at 70° C. for 3 hours, by immersing the specimen in a 5% salt solution of 50° C. for 2 hours, by leaving the specimen at room temperature in the ambient atmosphere, and by salt spraying at 50° C. in accordance JIS Z 2371 for one hour. The above-mentioned operations more repeated for 672 hours. The result was represented by a maximum depth of pits formed in the specimen.

The corrosion test for paint-coated specimen was carried out in the following manner. A specimen was subjected to an immersion type phosphate chemical conversion treatment and then to a cathodic electrodeposition paint coating to form a paint coating layer having a thickness of 20 μm. The coated specimen was cross-cut and the subjected to the same salt spray test as mentioned above, and to a cyclic corrosion test in which a cyclic treatment comprising salt spraying at 50° C. for 17 hours in accordance with JIS 2371, drying at 70° C. for 3 hours, salt spraying a 5% NaCl solution at 50° C. for 2 hours, and leaving in ambient atmosphere for 2 hours, was repeated for 2016 hours, and the result is represented by a maximum depth of pits formed in the specimen.

The plated steel strips and the paint-coated steel strip of Examples 120 to 127 in which the resultant zinc-chromium alloy plating layers did not have the η-phase exhibited a higher corrosion resistance than that of Example 128 in which the resultant zinc-chromium alloy plating layer had the η-phase.

TABLE 12

| Example No. | Composition of plating liquid $Zn^{2+}$ (g/l) | $Cr^{3+}$ (g/l) | $Na^{+}$ (g/l) | Additive Type | Amount (g/l) | pH | Plating condition Current density (A/dm²) | Flow speed of plating liquid (m/min) | Temperature (°C.) | X-ray diffraction pattern |
|---|---|---|---|---|---|---|---|---|---|---|
| Examples 120 and 125 | 65 | 52 | 15 | PEG*1 | 1 | 1.3 | 100 | 200 | 50 | FIG. 2 |
| Example 121 | 104 | 40 | 14 | PEG | 2 | 1.3 | 100 | 60 | 50 | FIG. 3 |
| Examples 122 and 126 | 28 | 50 | 15 | PEG | 1 | 1.0 | 83 | 170 | 50 | FIG. 4 |
| Examples 123 and 127 | 32 | 62 | 15 | PEG | 1 | 1.0 | 200 | 60 | 50 | FIG. 5 |
| Example 124 | 32 | 62 | 15 | PEG | 2 | 1.0 | 300 | 40 | 50 | |
| Example 128 | 32 | 25 | 9 | — | — | 1.3 | 200 | 150 | 50 | FIG. 1 |
| Comparative Example 36 | 32 | 25 | 9 | — | — | 1.3 | 100 | 100 | 50 | |

Note: *1Polyethyleneglycol (n = 20 to 60)

TABLE 13

| Example No. | Principal (base) plating layer: Composition Zn (%) | Cr (%) | Amount (g/m²) | X-ray diffraction pattern: d = 2.15 −2.12 Å | d = 2.29 −2.19 Å | d = 2.33 −2.36 Å | η-phase d = 2.10 d = 2.47 | Additional (surface) plating layer: Composition Fe (%) | Zn (%) | Amount (g/m²) | Corrosion resistance of plated steel strip: Salt spray test (%) | Cyclic corrosion test (mm) | Corrosion resistance of paint-coated steel strip: Salt spray test (%) | Cyclic corrosion test (mm) |
|---|---|---|---|---|---|---|---|---|---|---|---|---|---|---|
| Example 120 | 93 | 7 | 20 | None | Principal peak | None | None | — | — | — | 0 | 0.21 | 1.5 | 0.20 |
| Example 121 | 88 | 12 | 20 | Appeared | Principal peak | None | None | — | — | — | 0 | 0.17 | 1.5 | 0.10 |
| Example 122 | 85 | 15 | 20 | Principal peak | None | Appeared | None | — | — | — | 0 | 0.17 | 1.5 | 0.10 |
| Example 123 | 73 | 27 | 20 | Principal peak | None | None | None | — | — | — | 0 | 0.10 | 1.5 | 0.16 |
| Example 124 | 62 | 38 | 20 | Principal peak | None | None | None | — | — | — | 0 | 0.10 | 1.5 | 0.20 |
| Example 125 | 93 | 7 | 20 | None | Principal peak | None | None | 100 | 0 | 2 | 0 | 0.25 | 1.0 | 0.16 |
| Example 126 | 85 | 15 | 20 | Principal peak | None | Appeared | None | 80 | 20 | 3 | 0 | 0.20 | 1.0 | 0.16 |
| Example 127 | 73 | 27 | 20 | Principal peak | None | None | None | 65 | 35 | 3 | 0 | 0.17 | 1.0 | 0.10 |
| Example 128 | 91 | 9 | 20 | None | Appeared | None | Principal peak | — | — | — | 0 | 0.50 | 1.5 | 0.44 |
| Comparative Example 36 | 98 | 2 | 20 | None | None | None | Principal peak | — | — | — | 90 | 0.60 | 3.5 | 0.65 |
| Comparative Example 37 | 100 | 0 | 20 | None | None | None | Principal peak | — | — | — | 100 | 0.65 | 4.5 | 0.60 |

EXAMPLES 129 TO 134 AND COMPARATIVE EXAMPLE 38

In each of Examples 129 and 134 and Comparative Example 38, the same cold rolled steel strip was plated in a sulfate or chlorine type plating liquid having the composition, and under the plating conditions, indicated in Table 14.

The resultant plating layers of Examples 129 to 133 did not have the $\eta$ phase, but the resultant plating layers of Example 134 and Comparative Example 38 did have the $\eta$ phase.

The plated steel strips were subjected to the same cyclic corrosion test described in Examples 120 to 129. The results are shown in Table 14.

TABLE 14

| Example No. | Composition of plating liquid: $Zn^{2+}$ (g/l) | $Cr^{3+}$ (g/l) | Additive: Type | Additive: Amount (g/l) | Cation | pH | Other additive: Type | Other additive: Amount (g/l) | Plating condition: Current density ($A/dm^2$) | Plating condition: Flow speed of plating liquid (m/min) | Plating condition: Temperature (°C.) | Composition of plating layer: Zn (%) | Composition of plating layer: Cr (%) | X-ray diffraction pattern of plating layer: d = 2.15 – 2.12 Å | X-ray diffraction pattern of plating layer: d = 2.29 – 2.19 Å | X-ray diffraction pattern of plating layer: d = 2.33 – 2.36 Å | X-ray diffraction pattern of plating layer: η-phase d = 2.10 d = 2.47 | Cyclic corrosion test (mm) |
|---|---|---|---|---|---|---|---|---|---|---|---|---|---|---|---|---|---|---|
| Example | | | | | | | | | | | | | | | | | | |
| 129 | 102 | 40 | Polyethyleneglycol laurylether | 0.5 | Sulfate | 1.3 | — | — | 150 | 60 | 50 | 90 | 10 | Appeared | Principal peak | None | None | 0.10 |
| 130 | 27 | 49 | ENSA | 0.1 | " | 2.2 | $Na^+$ | 15 | 150 | 60 | 50 | 93 | 7 | None | Principal peak | Appeared | " | 0.20 |
| 131 | 38 | 34 | EN | 0.05 | " | 2.1 | $NH_4^+$ | 9 | 150 | 40 | 50 | 94 | 6 | " | Principal peak | Appeared | " | 0.20 |
| 132 | 91 | 35 | Polyethyleneglycol (n = 3–10) | 15 | " | 1.0 | $Mg^{2+}$ | 23 | 200 | 150 | 50 | 82 | 18 | Principal peak | Appeared | None | " | 0.16 |
| 133 | 72 | 26 | α-polyoxymethylene | 2 | Chlorine | 1.8 | $K^+$ | 15 | 150 | 60 | 50 | 89 | 11 | Appeared | Principal peak | None | " | 0.16 |
| 134 | 32 | 25 | None | | Sulfate | 1.3 | $Na^+$ | 9 | 350 | 100 | 50 | 78 | 22 | Principal peak | None | Appeared | Appeared | 0.30 |
| Comparative Example | | | | | | | | | | | | | | | | | | |
| 38 | 32 | 25 | None | | Sulfate | 1.3 | $Na^+$ | 9 | 100 | 100 | 50 | 98 | 2 | None | None | None | Principal peak | 0.65 |

EXAMPLE 135

The same cold rolled steel strip as that described in Example 111 was continuously plated in a sulfate type plating liquid comprising 107 g/l of zinc ions, 40 g/l of trivalent chromium ions, 14 g/l of sodium ions, anions consisting of sulfate ions, and 2 g/l of polyethylene glycol having a molecular weight of 1500 at a pH of 1.3, a current density of 150 A/dm$^2$, a flow rate of the plating liquid of 60 m/min, and a temperature of 50° C. by using an anode consisting of an insoluble Pb-4% Sn electrode, until the total quantity of electricity applied to the plating procedure reached 10,000 Coulomb/l. The resultant plating layer comprised 15% by weight of chromium and 85% by weight of zinc. After the 10,000 Coulomb/l loading, it was found that the concentration of hexavalent chromium ions ($Cr^{6+}$) was increased to 0.57 g/l.

The plating liquid was mixed with 1.8 g of metallic zinc powder per liter of the plating liquid and with an aqueous $CrO_3$ solution corresponding to 0.3 g/l of Cr per liter of the plating liquid, and the mixture was stirred at a temperature of 50° C. until a uniform plating liquid was obtained. The resultant refreshed plating liquid contained zinc ions and trivalent chromium ions at a similar content to that in the original plating liquid. The content of $Cr^{6+}$ in the refreshed plating liquid was 0.1 g/l or less.

The refreshed plating liquid was used for the same continuous plating procedure as that mentioned above at 10,000 Coulomb/l.

The above-mentioned cyclic process consisting of the continuous plating procedure and the refreshing procedures for the used plating liquid was repeated 6 times, until the load applied to the plating liquid reached 60,000 Coulombs/l.

After the above-mentioned continuous plating procedures were completed, all the resultant plating layers were composed of about 15% by weight of chromium and about 85% by weight of zinc, and had a good appearance.

After each refreshing procedure, the contents of $Zn^{2+}$ and $Cr^{3+}$ in the refreshed plating liquid were substantially the same as those of the original plating liquid and the content of $Cr^{6+}$ was 0.1 g/l or less.

EXAMPLE 136

The same plating and refreshing procedures as those described in Example 135 were carried out, with the following exception.

The original sulfate type plating liquid comprised 84 g/l of zinc ions, 49 g/l of trivalent chromium ions, 14 g/l of sodium ions, 2 g/l of a polyethylene glycol having a molecular weight of 1500 and anions consisting of sulfate ions, and had a pH of 1.2. The current density was 100 A/dm$^2$. A Pt anode was used.

After the 10,000 Coulomb/l load plating procedure, the resultant plating layer was composed of 15% by weight of chromium and 85% by weight of zinc, and the used plating liquid contained 0.1 g/l or less of $Cr^{6+}$.

In the refreshing procedure, an aqueous chromium chromate solution in an amount corresponding to 0.3 g/l of Cr was used in place of $CrO_3$. The aqueous chromium chromate solution was prepared by adding starch to an aqueous anhydrous chromic acid solution to reduce a portion of the anhydrous chromic acid and contained 30% of $Cr^{3+}$ and 70% of $Cr^{6+}$ based on the total amount of chromium.

Each of the resultant refreshed plating liquids contained zinc ions and trivalent chromium ions in the same contents as those of original plating liquid and 0.1 g/l or less of $Cr^{6+}$ ions.

EXAMPLE 137

The same plating and refreshing procedures as those described in Example 135 were carried out with the following exception.

The original plating liquid comprised 84 g/l of zinc ions, 49 g/l of trivalent chromium ions, 14 g/l of sodium ions, anions consisting of sulfate ions, 2 g/l of a polyethyleneglycol having a molecular weight of 1500 and had a pH of 1.2. The anode consisted of a Pb-1% Ag electrode.

After 10,000 Coulomb/l load plating procedure, the used plating liquid contained 0.76 g/l of $Cr^{6+}$ and 14 ppm of pb, and the resultant plating layer was composed of 15% by weight of chromium and 85% by weight of zinc.

The $CrO_3$ solution was replaced by an aqueous chromium sulfate solution in an amount corresponding to 0.3 g/l of chromium. In the refreshing procedures, 1.6 g of $SrCO_3$ per l of the plating liquid were further added to and dissolved in the plating liquid.

Each refreshed plating liquid contained zinc and trivalent chromium ions in the same contents as those in the original plating liquid and 0.1 g/l or less of $C^{6+}$ ions and 1 ppm or less of Pb.

EXAMPLE 138

Referring to FIG. 7, the dissolving vessel 7 having a diameter of 500 mm was charged with 330 kg of metallic zinc grains having a size of 2 mm to form a metallic zinc grain layer having a height of about 300 mm. The metallic zinc grain layer was pressed between the bottom and upper perforated plates 14 and 15.

A feed solution comprising 80 g/l of zinc ions, 40 g/l of trivalent chromium ions, 14 g/l of sodium ions, 0.2 g/l, in terms of $Cr^{6+}$, of chromic acid, 1.5 g/l of a polyethylene glycol having a molecular weight of 1500 and anions consisting of sulfate ions and having a pH of 1.0, was fed from a plating vessel (not shown in FIG. 7) to the dissolving vessel 7 through the conduit 16 and passed through the metallic zinc grain layer. The resultant refreshed plating liquid was returned to the plating vessel.

The above-mentioned procedures were continued or one hour. It was found that 36 kg of metallic zinc were dissolved in the plating liquid to reduce $Cr^{6+}$ ions into $Cr^{3+}$ ions. The content of $Cr^{6+}$ in the plating liquid at the outlet 17 was 0.1 g/l or less. That is, about 90% of the dissolved metallic zinc contributed to the reduction of the $Cr^{6+}$ ions.

EXAMPLES 139 TO 142 AND COMPARATIVE EXAMPLE 39

In each of Examples 139 to 142 and Comparative Example 39, a cold rolled steel strip was continuously plated in a plating liquid having the composition, and under the plating condition, as indicated in Table 15, until the total load reached 10,000 Coulomb/l. After completion of the continuous plating procedure, it was found the used plating liquid in Examples 139 to 142 contained a small amount of hexavalent chromium ions as shown in Table 15, whereas the used plating liquid in Comparative Example 19 contained a relatively large amount (0.55 g/l) of hexavalent chromium ions.

That is, the organic reducing agent and bromine ions contained in the plating liquid were effective for restricting the generation of the hexavalent chromium ions.

TABLE 15

| Example No. | Composition of plating liquid: $Zn^{2+}$ (g/l) | $Cr^{3+}$ (g/l) | Organic reducing agent: Type | Organic reducing agent: Amount (g/l) | Other additive: Type | Other additive: Amount (g/l) | Cation | pH | Plating condition: Current density ($A/dm^2$) | Relative flow rate of plating liquid (m/min) | Temperature (°C.) | Type of anode | After 10000 Coulomb/l load, content of hexavalent chromium in plating liquid: Hexavalent Cr (g/l) | Composition of plating layer: Zn % | Cr % |
|---|---|---|---|---|---|---|---|---|---|---|---|---|---|---|---|
| Example 139 | 107 | 40 | Starch | 16 | $Na^+$<br>Polyethylene glycol (MW = 1500) | 14<br>2 | Sulfate | 1.3 | 150 | 60 | 50 | Pb—4% Sn | 0.30 | 85 | 15 |
| Example 140 | 84 | 49 | Formic acid | 28 | $Na^+$<br>Polyethylene glycol (MW = 1500) | | " | 1.1 | 100 | 60 | 50 | Pb—1% Ag | 0.42 | 85 | 15 |
| Example 141 | 84 | 49 | Formic acid | 28 | $Na^+$<br>Polyethylene glycol (MW = 1500) | | " | 1.1 | 100 | 60 | 50 | Pb—1% Ag | 0.18 | 85 | 15 |
| Example 142 | 38 | 34 | $Br^-$<br>Ethylene-glycol | 24<br>40 | $NH_4^+$ | 9 | " | 2.1 | 300 | 150 | 50 | $PbO_2$ | 0.21 | 84 | 6 |
| Comparative Example 39 | 38 | 34 | — | | $NH_4^+$ | 9 | " | 2.1 | 300 | 150 | 50 | $PbO_2$ | 0.55 | 95 | 5 |

EXAMPLE 143

The used plating liquid in Example 140 was mixed with a chromic acid aqueous solution in an amount corresponding to 0.3 g/l of chromium and 0.9 g/l of formic acid and the mixture was heated at a temperature of 70° C. to reduce the hexavalent chromium. The resultant plating solution contained 0.1 g/l or less of hexavalent chromium.

The plating solution was further mixed with zinc carbonate ($ZnCO_3$) in an amount corresponding to 1.8 g/l of zinc and the amount of the plating solution was controlled so that the resultant refreshed plating liquid contained zinc ions and trivalent chromium ions in the same contents as those in the original plating liquid.

The above-mentioned plating and refreshing procedures were repeated 6 times until the total load applied to the plating liquid reached 60,000 Coulomb/l.

All of the plated steel strip had a zinc-chromium alloy plating layer composed of 15% by weight of chromium and 85% by weight of zinc. Also, all of the refreshing plating liquid contained zinc ions and trivalent chromium ions in the same contents as those in the original plating liquid and 0.1 g/l or less of hexavalent chromium.

We claim:

1. A corrosion resistant plated steel strip comprising a substrate consisting of a steel strip; and at least one principal plating layer formed on at least one surface side of the steel strip substrate and comprising a co-deposited zinc-chromium based alloy comprising chromium in an amount of more than 5% by weight but no more than 20% by weight and the balance consisting of zinc, and at least one additional plating layer formed on the principal plating layer, and comprising at least one member selected from the group consisting of iron and iron-based alloys.

2. The plated steel strip as claimed in claim 1, wherein the zinc-chromium based alloy further comprises at least one member selected from iron, nickel, cobalt, manganese, aluminum, silicon, molybdenum, copper, tin, titanium, cadmium and lead.

3. The plated steel strip as claimed in claim 1, wherein the zinc-chromium based alloy comprises more than 5% by weight of chromium, 5% by weight or more of at least one iron family metal, the total amount of the chromium and iron family metal being 40% by weight or less, and the balance consisting of the zinc.

4. The plated steel strip as claimed in claim 1 wherein the principal plating layer further comprises 0.2% to 20% by weight of fine particles of at least one metal oxide dispersed, therein.

5. The plated steel strip as claimed in claim 1, wherein the additional plating layer formed on the principal co-deposited zinc-chromium alloy plating layer, is a metal selected from the group consisting of alloys of 60% or more of iron with the balance being zinc.

6. The plated steel strip as claimed in claim 1, wherein the additional plating layer formed on the principal co-deposited zinc-chromium alloy plating layer is an iron-based alloy comprising iron, zinc and at least one member selected from the group consisting of Ni, Co, Mn, Sn and P.

7. The plated steel strip as claimed in claim 1, wherein the principal plating layer comprising the zinc-chromium alloy does not have a $\eta$ phase.

8. A corrosion resistant plated steel strip comprising a substrate consisting of a steel strip; and at least one principal plating layer formed on at least one surface side of the steel strip substrate and comprising a co-deposited zinc-chromium based alloy comprising chromium in an amount of more than 5% by weight but not more than 20% by weight and the balance consisting of zinc, and at least one additional plating layer formed on the principal plating layer, and comprising at least one member selected from the group consisting of zinc and zinc-based alloys.

* * * * *